US005494275A

United States Patent [19]

Yunoki et al.

[11] Patent Number: 5,494,275

[45] Date of Patent: Feb. 27, 1996

[54] CLOTH PIECE SUPPLY APPARATUS AND METHOD

[75] Inventors: Akio Yunoki; Kazunori Anda; Tsutomu Fudaki; Toru Shimizu, all of Toyama, Japan

[73] Assignee: Yoshida Kogyo K.K., Tokyo, Japan

[21] Appl. No.: 166,049

[22] Filed: Dec. 14, 1993

[30] Foreign Application Priority Data

| | | | |
|---|---|---|---|
| Dec. 14, 1992 | [JP] | Japan | 4-333032 |
| Dec. 14, 1992 | [JP] | Japan | 4-333033 |
| Dec. 14, 1992 | [JP] | Japan | 4-333034 |
| Sep. 29, 1993 | [JP] | Japan | 5-242898 |

[51] Int. Cl.[6] ..... B65H 3/44

[52] U.S. Cl. ..... 271/9.08; 271/9.12; 271/10.09; 271/10.16; 271/18.3; 271/158

[58] Field of Search ..... 271/9, 10, 18.3, 271/158, 9.07, 9.08, 9.12, 10.09, 10.16, 18.3, 158

[56] References Cited

U.S. PATENT DOCUMENTS

| | | | |
|---|---|---|---|
| 3,813,094 | 5/1974 | Walton et al. | 271/10 X |
| 4,019,729 | 4/1977 | Morton | 271/10 X |
| 4,157,825 | 6/1979 | Ellenberger et al. | 271/10 |
| 4,703,924 | 11/1987 | Marass | 271/158 X |
| 5,222,860 | 6/1993 | Kamath et al. | 271/9 X |
| 5,271,710 | 12/1993 | Decharran et al. | 414/798.9 |

FOREIGN PATENT DOCUMENTS

| | | | |
|---|---|---|---|
| 0464771 | 1/1992 | European Pat. Off. . | |
| 1513666 | 2/1968 | France . | |
| 1126719 | 3/1962 | Germany . | |
| 0177838 | 10/1983 | Japan | 271/18.3 |
| 1668262 | 8/1991 | U.S.S.R. | 271/18.3 |
| 2183609 | 6/1987 | United Kingdom . | |

*Primary Examiner*—William E. Terrell
*Assistant Examiner*—Carol L. Druzbick
*Attorney, Agent, or Firm*—Hill, Steadman & Simpson

[57] ABSTRACT

A cloth pick-up apparatus is used which comprises pressing mechanism for a pressing one end of the top cloth piece from the upper side, a catch roller having on a part of its circumferential surface catch needles and movable toward and away from the other end of the top cloth piece, the catch roller being adapted to be driven for rotation to feed the top cloth piece in a direction remote from the pressing mechanism, a feed roller rotatable in timed relation with the catch roller, and a pressure roller movable toward and away from a cloth-piece-feed surface of the feed roller and rotatable in cooperation with the feed roller. The catch roller is rotated touching one end of front face of the cloth pieces with the other end of the cloth piece pressed by the pressing roller so that the upper most cloth piece is caught by the catch needles and, at the same time, is raised. Then the cloth pieces are fed one by one to the next station as the individual cloth piece is clamped between the feed surfaces of the feed roller in driven rotation and the pressure roller.

12 Claims, 21 Drawing Sheets

CLOTH PIECE SUPPLY APPARATUS AND METHOD

BACKGROUND OF THE INVENTION

1. Field of the Invention

This invention relates to a cloth piece supply machine and method in which cloth pieces for front flies of such trousers such as denim pants are conveyed successively in stack to, for example, a continuous slide fastener chain and are picked up one by one from the top of the stack, without being damaged, and the cloth pieces, with front faces facing in the same direction, are then supplied to, for example, a sewing machine, thus enabling a high-speed feed of cloth pieces.

2. Description of the Related Art

In attaching successive cloth pieces to a continuous slide fastener chain, it is necessary to supply the cloth pieces one in one or two seconds to meet the modern high-speed sewing machine. For this purpose, a large quantity of cloth pieces must be always previously stocked in a cloth piece supply station. However, since forty to fifty cloth pieces are supplied but in a minute, it is extremely difficult to stock in a single position a necessary quantity of cloth pieces to be processed in the working time.

To cope with this, a solution has been proposed, in which several tens cloth pieces in stack is placed in each of a number of cloth piece support portions arranged in a circle on a rotary disc, the rotary disc is intermittently rotated to move the individual support portion to the cloth piece supply position, whereupon the cloth pieces are picked up one by one from the top of the stack in the support portion and are successively supplied to a sewing station. When all the cloth pieces of one stack in the support portion has been supplied up, the rotary disc is rotated again to move the next support portion to the cloth piece supply position. While the rotary disc is thus in rotation, a new stack of cloth pieces is placed he on the individual emptied support portion.

In this kind of cloth piece pick-up apparatus, the cloth pieces are picked up by peeling one by one from the stack in the cloth piece supply position, and are then supplied to the next or sewing station. At that time, if even a single cloth piece cannot be picked up or more than one cloth piece is picked up at once, the whole machine has to be stopped in the worst case so that the working rate would be lowered to create wastage, thus causing an increased cost of production. To this end, following methods have been proposed in an effort to reliably pick up the cloth pieces one by one.

According to one conventional pick-up method disclosed in, for example, Japanese Patent Laid-Open Publication No. HEI 1-221196, a pair of front and back rollers are used to pick up the vertically stacked cloth pieces one after another from the top of the stack. Each roller has a number of catch needles projecting from the circumferential surface and arranged in a row parallel to the axis of the roller. In operation, the two rollers are lowered to press against the front face of the cloth piece and, at the same time, are rotated through a predetermined angle so as to pull the cloth piece, whereupon the cloth piece as kept hooked on the two rollers is fed to a predetermined position where the two rollers are rotated reversely to release the cloth piece.

According to another conventional pick-up method disclosed in, for example, Japanese Patent Publication No. SHO 63-28635, a pick-up mechanism is situated in front of the horizontally stacked cloth pieces to pick up the cloth pieces one by one from the front side of the stack. In this conventional method, a roller rotatably supported on the end of a pivoting plate pivotally movable about its one long side cooperates with a claw projecting perpendicularly from an inner portion of the plate to pick up only the frontmost cloth piece. Further, U.S. Pat. No. 3,685,471 discloses a pick-up mechanism which activated two shuttles synchronously to separate a cloth piece from the succeeding cloth pieces and catched the separated cloth piece by a pawl movable back and forth horizontally along the front face of the cloth piece to feed it sideways.

What to be noted in connection with this kind of cloth piece supply station is that the cloth pieces must be rearranged in such a manner that front faces face in the same direction, before being fed to the next station. This problem is inevitable as long as it is intended to stack the successive cloth pieces efficiently. It has currently been a common practice to fold a continuous strip of cloth in a zig-zag pattern and then to cut the cloth strip into a predetermined shape of cloth pieces. Consequently, front faces of every other cloth pieces of the stack faces inversely; if the thus stacked cloth pieces are fed one after another to the next station, the successive cloth pieces will be received in that station necessarily with front faces facing up and down alternately. In order to place all cloth pieces with front faces facing in the same direction, a means for placing the successive cloth pieces with front faces facing in the same direction must be situated in the cloth piece feed path.

Japanese Patent Publication No. SHO 63-28635 and U.S. Pat. No. 3,685,471 disclose a means for detecting the direction in which one face of the individual cloth piece being faces and then rearranging the successive cloth pieces in such a manner that front faces face in the same direction. Especially in U.S. Pat. No. 3,685,471, a means for inverting the cloth piece is disclosed in detail, according to the description of which the picked up cloth piece is fed the gap between a pair of parallel endless belts and, at the same time, when the cloth piece is discriminated necessary to be inverted, the front end of the pair of endless belts is angularly moved by 180° to twist the endless belts so that front faces of the successive cloth pieces will face in the same direction as they are fed by the endless belts.

However, in the conventional cloth piece supply machine in which the cloth piece stacks are arranged in one circle on the rotary disc, the distance between adjacent cloth piece stacks progressively increases toward the peripheral edge remote from the center the disc. In order to arrange as many cloth piece stacks as possible in one circle on the rotary disc to reduce the frequency of supplying new cloth pieces to cope with high-speed operation, it is inevitable to increase the diameter of the rotary disc so that no effective use of space can be achieved.

Further, in this kind of cloth piece supply machine, in order to pick up the cloth pieces reliably, it is advisable that the cloth piece to be picked up next should exist in a predetermined pick-up position, irrespective of whether the cloth piece is to be picked up from the top or side of the stack, depending on the vertical or horizontal stack.

In the cloth piece pick-up method disclosed in Japanese Patent Laid-Open Publication No. HEI 1-221196, partly since the cloth piece caught by the two rollers is tensed unnecessarily and tends to have a rent, and partly since the two rollers repeat three actions of catching, feeding and releasing the cloth piece, it is difficult to follow high-speed operation of the sewing machine.

In the cloth piece pick-up method disclosed in Japanese Patent Publication No. SHO 63-28635 and U.S. Pat. No.

3,685,471, the cloth pieces are stacked horizontally in the cloth piece supply station. Generally in this kind of cloth piece processing machine, the cloth piece assumes a horizontal posture while being processed in the processing station. Consequently, it is necessary to change the posture of the cloth piece from vertical to horizontal until the cloth piece reaches the processing station. This means that another action is added to the operation of the feed apparatus so that it would be made complex in mechanism and it would also be difficult to cope with the high-speed operation. Further, in the case where the cloth pieces are stacked horizontally, it requires an additional mechanism in order to maintain the posture of the cloth pieces to be picked up, which makes the entire mechanism much more complex.

With the cloth piece feed apparatus disclosed in U.S. Pat. No. 3,685,471, since the horizontally stacked cloth pieces is picked up one by one from the front side of the stack by the pick-up apparatus, the picked up cloth piece is fed forwardly in a vertical plane so that it will be supplied to the space between a pair of endless belts wound on two rotary shafts situated parallel to each other in the vertical plane. Therefore, if the front faces of the cloth pieces are to face in the same direction, the discharge end of the belts are twisted by 180° at maximum so that the front faces of the cloth pieces can face in the same direction.

In the case where the cloth piece inverting and feeding means disclosed in the above-mentioned U.S. Patent is to be incorporated using the method in which the vertically stacked cloth pieces are picked up one by one from the top of the stack, it is necessary to angularly move the discharge ends of the belts by 360° to twist the belts in order to invert the cloth piece being supplied in a horizontal posture, so that the belts cannot be driven and it would be very difficult to secure a timed operation. It is therefore impossible to apply the cloth piece inverting and feeding method, in which the cloth piece is twisted, to the method in which the vertically stacked cloth pieces are to be picked up one by one from the top of the stack, without reconstruction.

SUMMARY OF THE INVENTION

A first object of this invention is to provide a cloth piece supply machine which can cope with high-speed operation and can achieve effective use of space by arranging a cloth-piece-stack feed path rationally and can pick up the cloth pieces in a fixed position.

Another object of the invention is to provide a cloth piece pick-up apparatus which is equipped with a rational mechanism such that stacked cloth pieces can be picked up one by one from the top of the stack reliably without damage and which can simplify the mechanism.

Still another object of the invention is to provide a cloth piece feed apparatus which can invert and feed cloth pieces reliably, even though the method in which vertically stacked cloth pieces are picked up one by one from the top of the stack is used.

In order to accomplish the above objects, according to a first aspect of the invention, there is provided a cloth piece pick-up apparatus for picking up cloth pieces in a stack one by one from the top of the stack, comprising: pressing means for pressing one end of the top cloth piece from the upper side; a catch roller having on a part of its circumferential surface catch needles and movable toward and away from the other end of the top cloth piece, the catch roller being adapted to be driven for rotation to feed the top cloth piece in a direction remote from the pressing means; a feed roller rotatable in timed relation with the catch roller; and a pressure roller movable toward and away from a cloth-piece-feed surface of the feed roller and rotatable in cooperation with the feed roller. The pick-up apparatus further comprises a guide plate having one end which is contiguous to an upper surface of the pressure roller and extends horizontally in a direction of discharging the cloth piece and cooperative with the pressure roller.

It is preferable that the pressing means includes a pressure block having on its bottom catch needles and resiliently movable in a direction of pulling the cloth piece, and a cloth piece removal block for removing the cloth piece off the catch needles.

The feed roller may be situated in a fixed position downstream of the catch roller or may be situated coaxially of the catch roller. Further, the feed roller may be positively driven for rotation; or the pressure roller may be positively driven for rotation, and the feed roller may be pressed against the pressure roller for corotation therewith. The catch roller may be rotatable forwardly and reversely through a predetermined range of angle.

According to a second aspect of the invention, there is provided a method of picking up cloth pieces in a stack one by one from the top of the stack, using the cloth piece pick-up apparatus by repeating the following steps for feeding the cloth pieces successively to a subsequent manufacturing station: bringing the catch roller, which is in rotation as being driven, closely to the upper surface of the leading end portion of the cloth piece which is opposite to the end portion pressed on the upper surface by the pressing means; catching the top cloth piece with the catch needles of the catch roller and, at the same time, raising the top cloth piece to bring the surface of the leading end portion of the cloth piece into contact with the feed surface of the feed roller, which is in rotation as being driven; and pressing the leading end portion of the cloth piece against the feed roller by the pressure roller which is moved at the same time when the leading end portion of the cloth piece is brought into contact with the feed surface of the feed roller. The cloth pieces in stack are raised stepwise at a pitch corresponding to the cloth thickness in a cloth piece pick-up position in time relation with the action of picking up.

In operation, firstly, a necessary number of cloth piece receiving boxes each for receiving cloth pieces in stack are prepared. In this preparing, the distance between opposite sidewalls of the individual cloth piece receiving box is adjusted to fit to the size of the cloth piece. A required number of cloth pieces are stacked in each of the thus prepared cloth piece receiving boxes.

The plural cloth piece receiving boxes each accommodating the cloth pieces in stack are arranged in and along the rectangular frame-shape conveying path of the cloth piece conveying apparatus. Upon actuation of the cloth piece conveying apparatus, the cloth piece pick-up apparatus starts operating to pick up the cloth pieces one by one from the top of the stack in the cloth piece receiving box situated under the pick-up apparatus and to supply the successive cloth pieces to the cloth feed apparatus, which is the next station. At that time, upon receipt of a signal from the control unit, the cloth piece coveying apparatus raises the elevating plate in timed relation with the cloth piece pick-up rate. When the cloth piece receiving box is emptied, it will be conveyed to the next position downstream.

When the succeeding cloth piece receiving box is conveyed to the pick-up position, the positioning means is activated to position and stop the receiving box in the pick-up position. Meanwhile the conveying direction of the empty receiving box is changed by a right angle so that the empty receiving box will be transferred to the opposite conveying path where it is to be conveyed reversely, during which new cloth pieces in stack are received in the cloth piece receiving box by a suitable means.

The newly loaded cloth piece receiving box together with its adjacent receiving box is conveyed downstream along the conveying path. The cloth piece receiving box located at this downstream end will be returned to the upstream end of the original conveying path as the conveying path is shifted by a right angle. Thus the plural receiving boxes will successively circulate in the rectangular frame-shape conveying path.

At the cloth piece pick-up position, the pressing means in the form of a mere pressing roller stays in the pressing position until all the cloth pieces stacked in the receiving box has been picked up by the catch roller, whereupon the pressing roller will be raised to a standby position at which it will wait until the succeeding cloth piece receiving box is conveyed to the position beneath thereof. As the succeeding receiving box is conveyed to that position and is stopped there, the pressing roller will be lowered to press against the trailing end of front face of the uppermost cloth piece in the receiving box.

As the catch roller repeats forward and reverse rotations within a predetermined angle, it reciprocatingly moves between an raised position off the cloth piece stack and a lowered position contacting the front face of the uppermost cloth piece of the stack each time a single cloth piece is picked up by the catch needles projecting from the circumferential surface of the catch roller.

The feed roller is situated in such a position that its lower surface is substantially flush with the lower surface of the catch roller in the raised position. The feed roller is normally rotating in the cloth piece feeding direction. When the catch roller catches the leading end of the cloth piece and raises it, the leading end of the cloth piece will come into contact with the lower surface of the feed roller.

The pressure roller is rotatably situated at a position downstream an diagonally downwardly of the feed roller and diagonally moves reciprocatingly between a standby position diagonally downward of the feed roller and a raised position contacting the feed roller. As the timing for this recirprocating motion is controlled by instructions from a non-illustrated control unit, a single cloth piece is caught by the catch needles and is raised together with the catch roller, whereupon the pressure roller moves diagonally upwardly toward the feed roller to clamp the front end of the cloth piece between feed roller and the pressure roller. At that time, the guide plate along with the pressure roller is reciprocatingly moved diagonally between the raised position and the standby position.

In this case, since the feed roller is rotating during the reciprocating movement of the pressure roller, the cloth piece is positively fed downstream as its end is clamped between the feed and pressure rollers, at which time the cloth piece will be removed from the catch needles of the catch roller simply without any resistance. The cloth piece fed by the feed roller is guided downstream on the guide plate. When a single cloth piece is fed downstream, the pressing roller presses against the front face of another cloth piece to be picked up next. Subsequently, as the foregoing operation is repeated, the cloth pieces will be picked up one by one from the top of the stack in the receiving box and are fed to the cloth piece feed apparatus downstream.

The front/back face detector of the cloth piece feed apparatus detects whether the front face of the thus fed cloth piece faces upwardly or downwardly. If the cloth piece is supplied with its front face facing upwardly, the control unit will issue an instruction to the individual parts of the cloth piece feed apparatus based on a detection signal from the detector. In this case, first and second feed path switching members assume their original positions, and a pair of first feed rollers and a pair of inverting feed rollers rotate in the same direction as that of a pair of second feed rollers to feed the cloth piece to the next station along a straight path.

If the cloth piece is supplied with its back face facing upwardly, the control unit issues a detection signal to the individual part of the cloth piece feed apparatus. According to this instruction signal, the first feed path switching member is activated to switch the cloth piece feed path to the shunting position from the normal position, with the first feed path switching member kept in the original position. Now, the pair of first feed rollers and the inverting feed rollers are rotated in the same direction as that of the pair of second feed rollers to feed the cloth piece downstream. The second feed path switching member guides the cloth piece to the shunting path under the pair of first feed rollers. Before the trailing end of the cloth piece leaves the pair of first feed rollers, the same feed rollers start reverse rotation to feed the cloth piece backwardly and, at the same time, the straight feed path on the side toward the pair of second feed rollers is closed by switching the first feed path switching member. At that time, the inverting feed rollers also are reversely rotated, and the cloth piece backwardly fed by the reverse rotation of the pair of first feed rollers is inverted and fed along the circumferential surface of the reversely rotating inverting feed rollers. As the cloth piece is started to be inverted and fed along the circumferential surface of the upper inverting feed roller, the second feed path switching member is switched to the normal feed path.

The cloth piece backwardly fed with the back face facing upwardly is guided by the first feed path switching member, and then it is fed along the circumferential surface of the upper inverting feed roller, with the front face facing upwardly. The cloth piece then reaches the straight path upstream of the pair of first feed rollers via an inverting path, and thence it is transferred to a transfer table along the normal straight path and is fed to the sewing machine of the next station.

DETAILED DESCRIPTION

Typical embodiments of this invention applied to a sewing machine for sewing cloth pieces of denim successively to a continuous slide fastener chain will now be described in detail with reference to the accompanying drawings. This invention should be no means be limited to the following embodiments.

Figure 1:
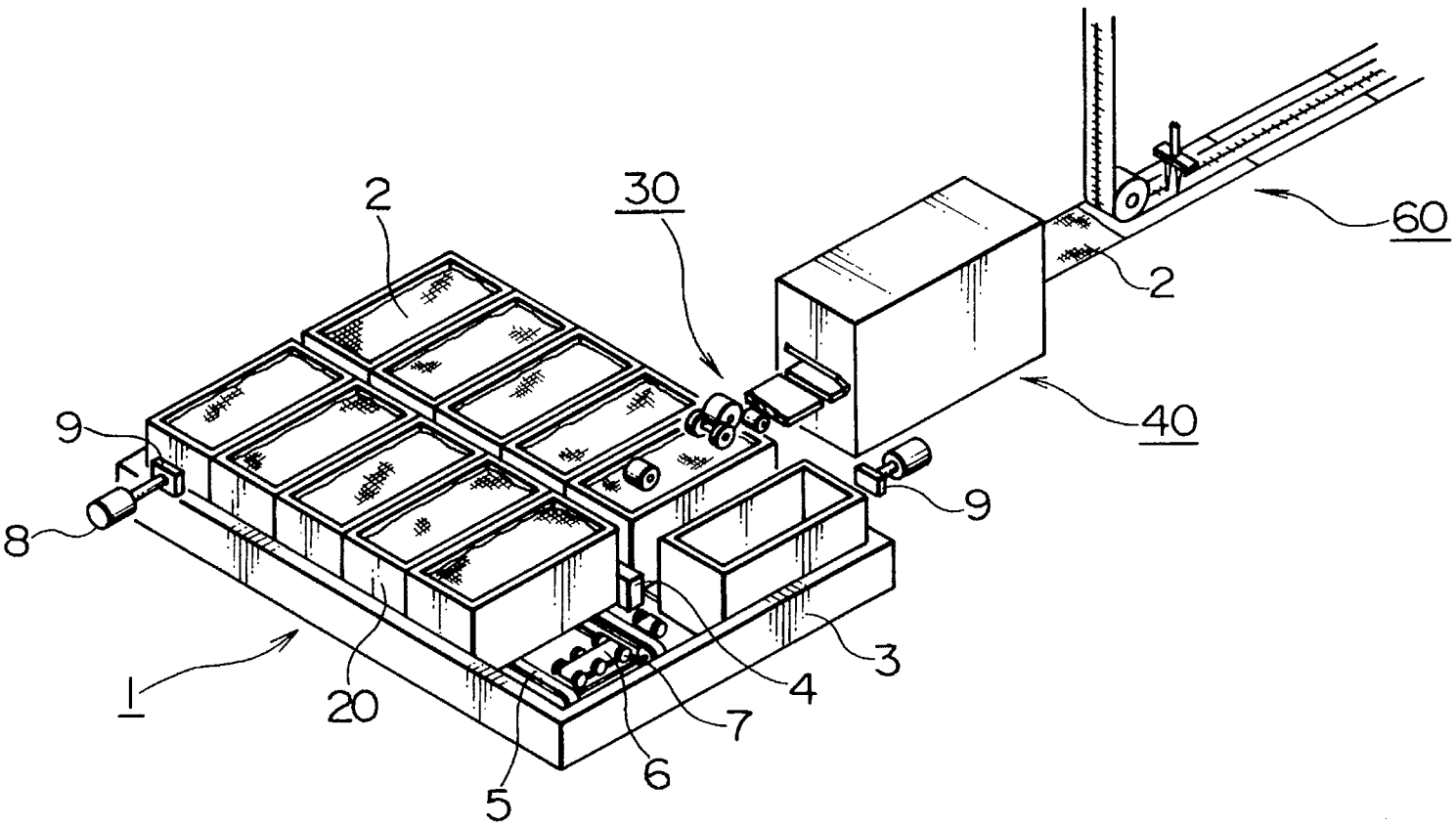
FIG. 1 is a perspective view of a cloth piece supply machine which comprises a cloth piece conveying apparatus, a cloth piece pick-up apparatus and a cloth piece feed apparatus and which is applied to an automatic sewing machine, according to this invention.
Figure 2:
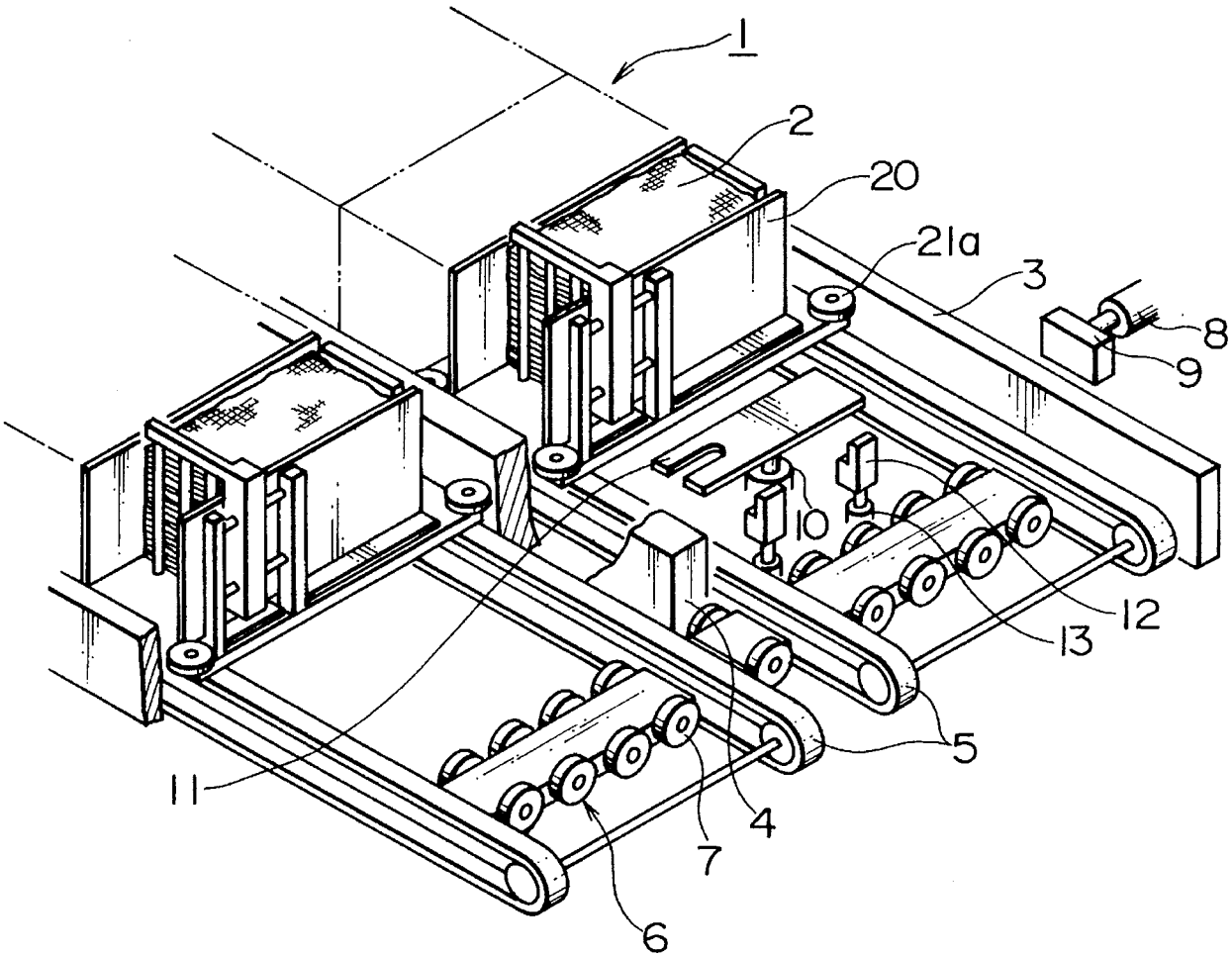
FIG. 2 is a fragmentary enlarged perspective view showing the cloth piece conveying apparatus FIG. 1.

FIG. 1 shows a sewing machine for picking up cloth pieces 2 one by one from a cloth piece conveying apparatus 1 by a cloth piece pick-up apparatus 30, and supplying the cloth pieces successively to a sewing part 60, with their front faces facing in the same direction in a cloth piece feed apparatus 40. FIG. 2 is an enlarged perspective view, with parts broken away, of the cloth piece conveying apparatus 1 of the invention.

In this embodiment, a rectangular frame-like guide wall 3 is divided horizontally centrally by an intermediate guide wall 4. The intermediate guide wall 4 is set to be shorter than each of opposite longer sides of the rectangular frame-like guide wall 3 so that opposite ends of the intermediate guide wall 4 terminate short of the respective shorter sides of the rectangular frame-like guide wall 3 by a predetermined distance. In the bottom of each of a horizontal pair of spaces defined between the opposite longer sides of the rectangular frame-like guide wall 3, there are situated two endless conveyer chains 5 along the inner wall surface of each longer side of the guide wall 3 and each wall surface of the intermediate guide wall 4. These four endless conveyer chains 5 are synchronously driven continuously or intermittently by a drive source such as a non-illustrated electric motor. The two pairs of endless conveyer chains 5 in opposite spaces are driven in opposite directions.

A guide table 6 with a number of rollers 7 attached to opposite side surfaces extends perpendicularly to the endless conveyer chains 5 through the gap between each end of the intermediate guide wall 4 and the respective shorter side of the guide wall 3. The upper surfaces of the rollers 7 are horizontally aligned with the upper surfaces of the endless conveyer chains 5. Confronting one end of the guide table 6 and outside the downstream end of each pair of the outer endless conveyer chains 5, a pusher 9 to be activated to move perpendicularly to the endless conveyer chain 5 by an air cylinder 8 is situated as shown in FIG. 1.

With this arrangement, the cloth piece receiving box 20 conveyed to the end by the endless conveyer chains 5 is fed on the rollers 7 in a direction perpendicularly to the endless conveyer chains 5 as the box 20 is pushed on one side surface by one pusher 9, so that the box 20 will be transferred onto the other endless conveyer chains 5, which are reversely driven, where the box 20 will be conveyed downwardly. At the downstream end of the endless conveyer chains 5, the cloth piece receiving box 20 is pushed again on the other side surface by the other pusher 9 to return to the original upstream end of the endless conveyer chains 5 via the rollers 7. Thus the cloth piece receiving box 20 is circulated on the endless conveyer chains 5 via the rollers 7. Therefore, the endless conveyer chains 5 and the rollers 7 form a circulating path along the inside wall surfaces of the rectangular frame-like guide wall 3.

Figure 3:
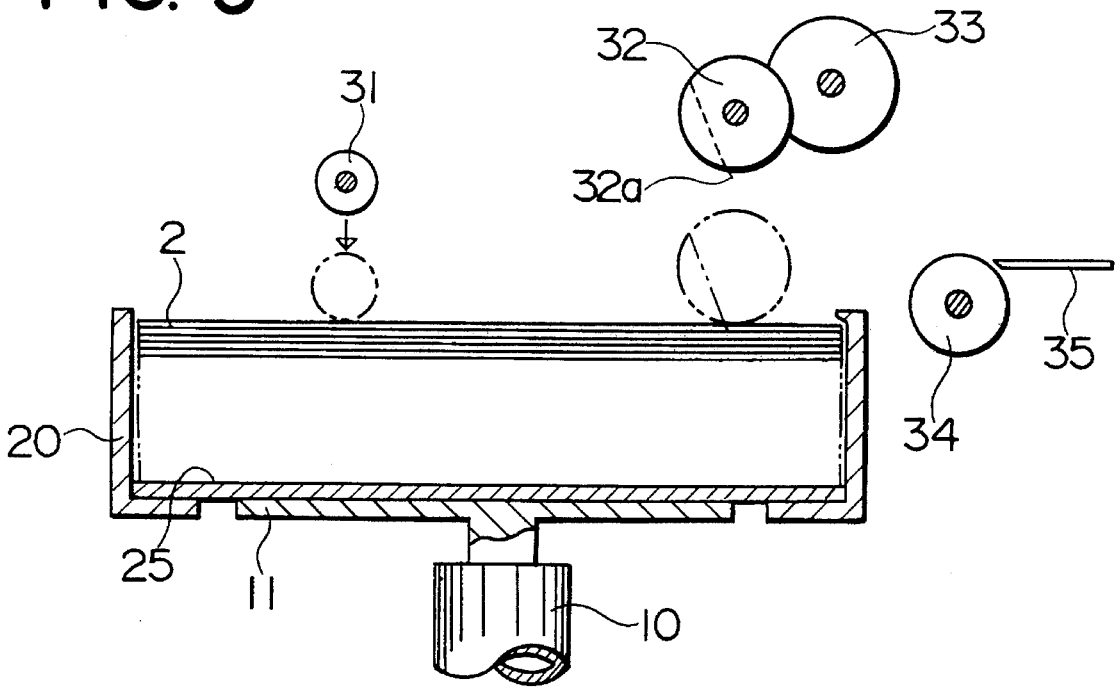
FIG. 3 is a vertical cross-sectional view showing a cloth piece receiving box and a cloth piece pick-up apparatus which are to be incorporated in the cloth piece conveying apparatus.

As shown in, FIG. 3, an elevating plate 11 is provided to be controlled by a cylinder 10. In the embodiment of FIGS. 1 and 3, the elevating plate 11 is situated corresponding to a position in which the cloth piece pick-up apparatus 30 is to be located; this position is a central portion of the conveying path and upstream of the downstream end of One pair of endless conveyer chains 5 by a distance corresponding to the length of a single cloth piece receiving box 20. The cylinder 10 is activated, upon receipt of a signal from a non-illustrated control unit, to raise the elevating plate 11 gradually in time relation with the rate of pick-up of the cloth pieces 2. A horizontal pair of stoppers 12 are situated in downstream side conveying path adjacent to the elevating plate 11. The stopper 12, which is able to be raised by a cylinder 13, will be lowered upon completion of supply of all the cloth pieces 2 in the preceding cloth piece, receiving box 20 and will be raised again, after the passage of the preceding cloth piece receiving box 20, to position and stop the succeeding cloth piece receiving box 20, which is being conveyed on the endless conveyer chains 5, in this position.

Figure 4:
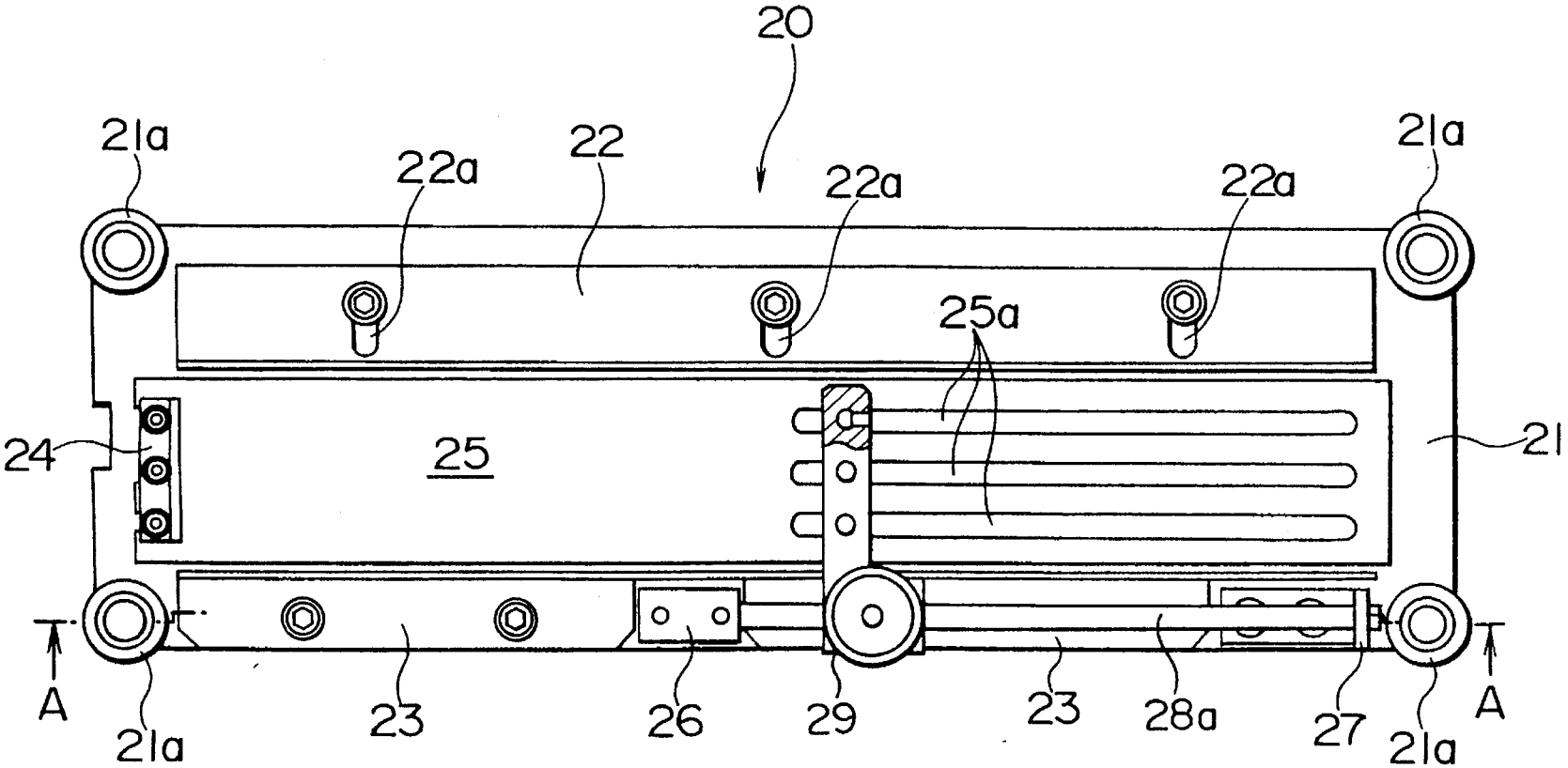
FIG. 4 is a plan view showing the cloth piece receiving box.
Figure 5:
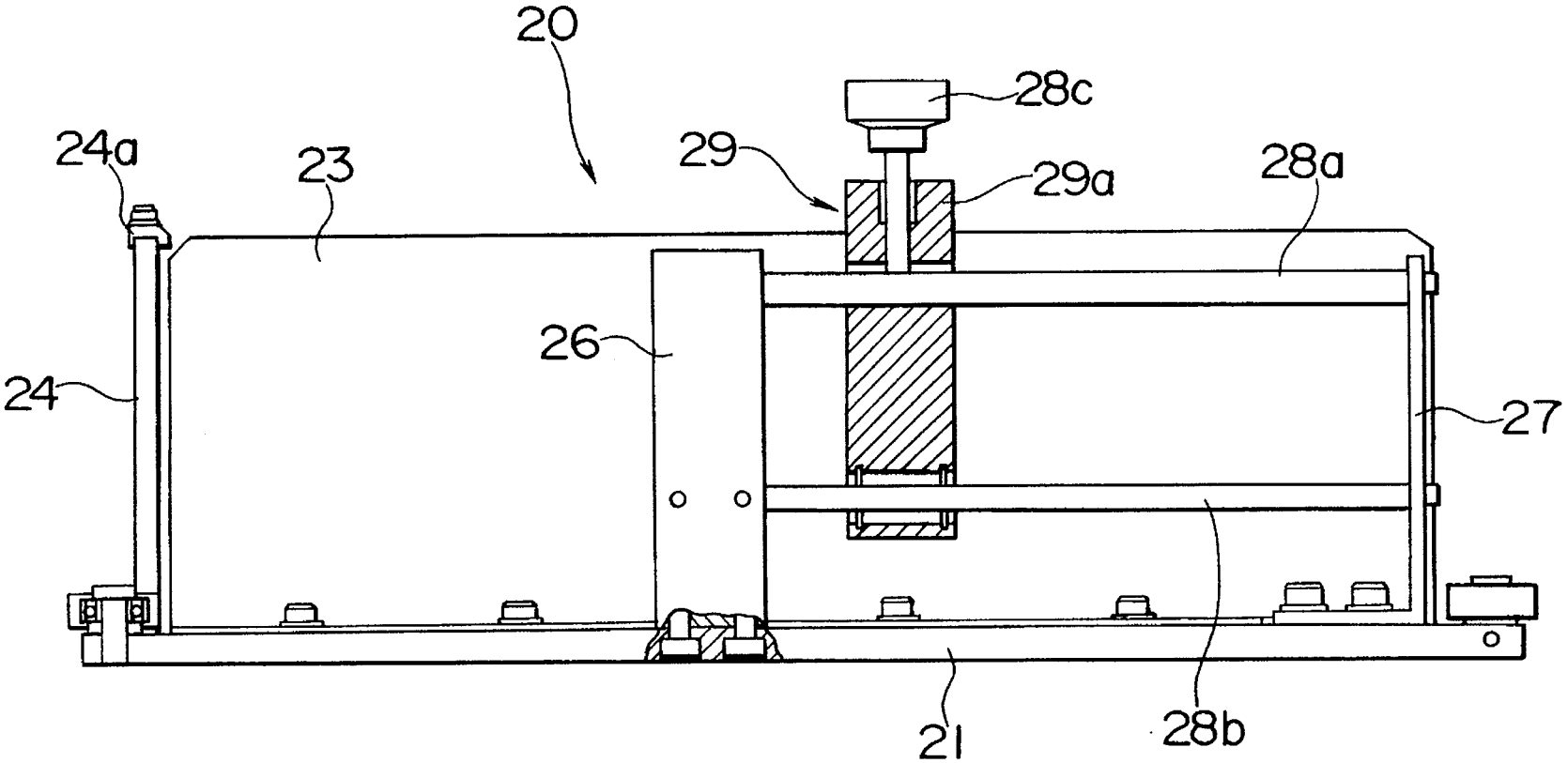
FIG. 5 is a cross-sectional view taken along line A—A of FIG. 4.
Figure 6:
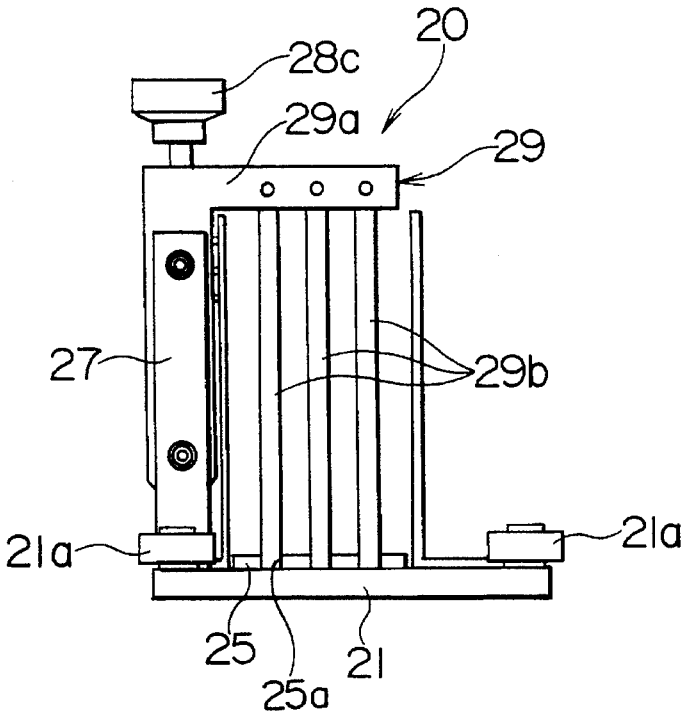
FIG. 6 is a side view of the cloth piece receiving box.

FIGS. 4 through 6 shows the construction of the cloth piece receiving box 20. FIG. 4 is a plan view of the cloth piece receiving box 20; FIG. 5, a cross-sectional view taken along line A—A of FIG. 4; and FIG. 6, a side view of the cloth piece receiving box 20. As is apparent from these views, the cloth piece receiving box 20 has in its bottom plate 21 a central rectangular opening whose size is such that the elevating plate 14 can pass through. A guide roller **21*a* is mounted on each of four corners of the bottom plate 21 for rotation about a vertical axis, with part of the roller surface projecting from the bottom plate 21. A pair of longer side wall members 22, 23 having an L-shape cross section are attached to opposite longer edges (upper and lower edges of FIG. 4) of the bottom plate 21, and one longer side wall member 22 has a number of transverse slots 22*a* so that the longer side wall member 22 can be moved transversely to adjust the distance between the opposite side wall members 22, 23 in conformity with the width of the cloth pieces 2 to be received. On one end of the bottom plate 21, a number of rods 24 are mounted at regular distances along an edge of the opening and their upper ends ar connected by a connecting member 24***a*.

Figure 15:
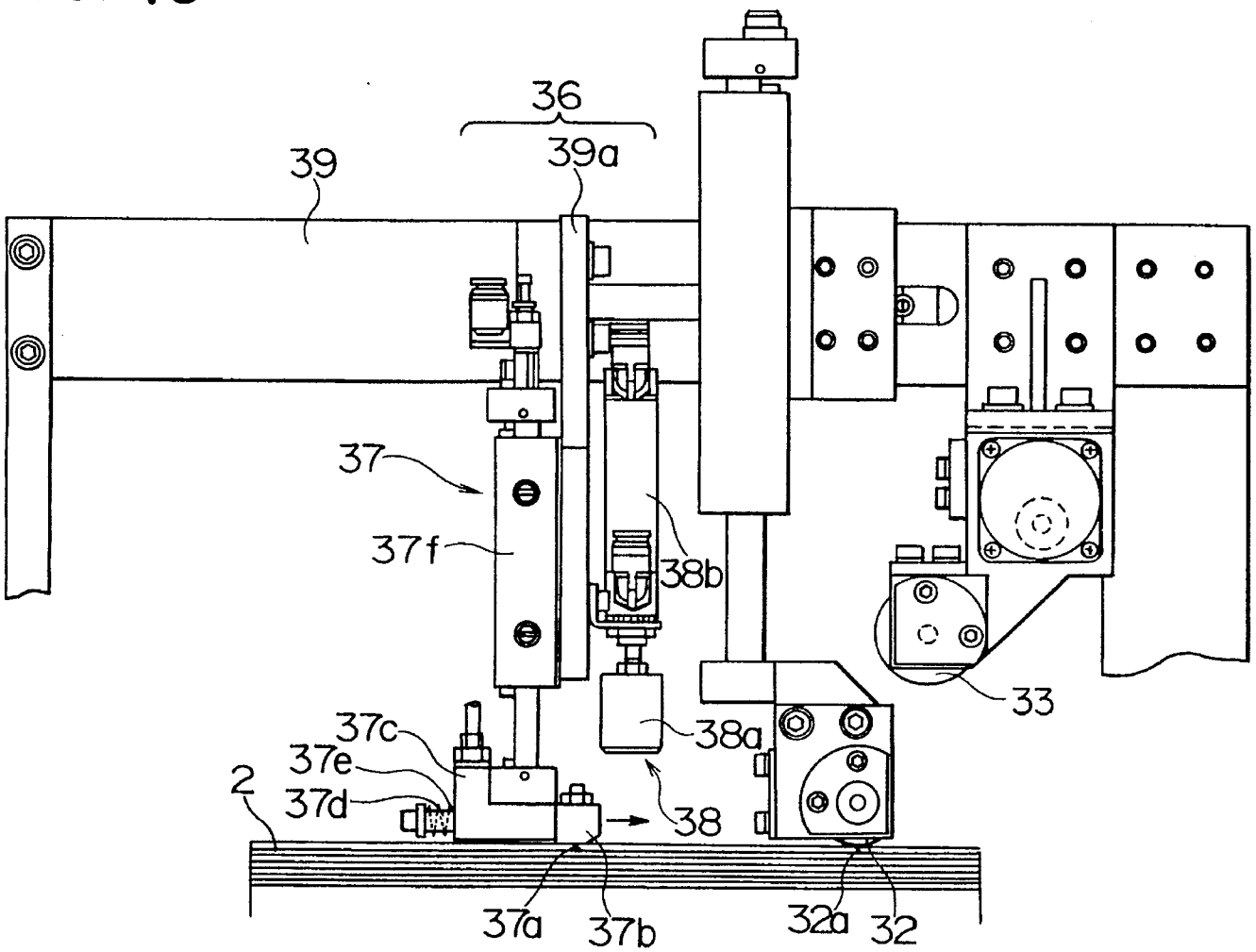
FIG. 15 shows the cloth piece pick-up apparatus of FIG. 13 when the pick-up of a cloth piece is started.

On the upper surface of the bottom plate 21, a cloth piece support plate 25 is supported so as to be received between the longer side wall members 22, 23 and the plural rods 24. The cloth piece support plate 25 has a generally rectangular shape as shown in FIG. 15 and in a substantially half part remote from the rods 24 a number of transversely parallel slit-like holes 25*a*.

A support post 26 is mounted centrally on one edge, to which one longer side wall member 23 is attached, of the bottom plate 21, and an L-shape bracket 27 is mounted on the same edge at the end remote from the rods 24. The support post 26 and the L-shape bracket 27 are connected at their upper end portions and their intermediate portions by upper and lower guide bars 28*a*, 28*b*. One end of a vertical grid member 29 constituting one of remaining side walls of the cloth piece receiving box 20 is slidably mounted on the upper and lower guide bars 28*a*, 28*b* and can be fixed in an arbitrary position by fastening a fastening screw 28*c* to the upper guide bar *28a*. The vertical grid member 29, as is apparent from FIG. 6, includes an L-shape frame member 29*a* and a number of vertical bars 29*b* extending from the upper horizontal arm and spaced at predetermined distances. The distance between the vertical bars 29*b* is equal to the distance between the slit-like holes 25*a* of the cloth piece support plate 25, and the diameter of the vertical bars 29*b* is such that they can be inserted through the slit-like holes 25*a*.

With the foregoing cloth piece conveying apparatus 1, a necessary number of (e.g., eleven in the embodiment of FIG. 1) cloth piece receiving boxes 20 to be supported on the cloth piece conveying apparatus 1 are previously prepared.

For this preparation, the longer side wall member 22 is moved for positional adjustment in conformity to the width of the cloth pieces 2 and is fixed in that position, and the vertical grid member 29 slides on the upper and lower guide bars 28*a*, 28*b* in conformity to the length of the cloth pieces 2, whereupon the fastening screw 28*c* is tightened at a predetermined position to fix the vertical grid member 29. Each of the cloth piece receiving boxes 20 thus prepared receives a required number of cloth pieces 2 in stack.

The prepared cloth piece receiving boxes 20 are placed on the conveying path of the cloth piece conveying apparatus 1. As the sewing machine is started, the cloth piece conveying apparatus 1 of this invention will start operation, together with the cloth piece pick-up apparatus 30, the cloth piece feed apparatus 40 and the sewing part 60, in synchronism therewith, based on an instruction from a non-illustrated control unit. In the cloth piece conveying apparatus 1, the cloth pieces 2 received in stack in the cloth piece receiving box 20 situated under the pick-up apparatus 30 are picked up one by one from the top of the stack by the action of the pick-up apparatus 30 and are then supplied to the cloth piece feed apparatus 40 in the next station. At that time, upon receipt of a signal from the non-illustrated control unit, the cylinder 10 is activated to raise the elevating plate 11 in timed relation with the rate of pick-up of the cloth pieces 2. The stoppers 12 will be lowered when the cloth piece receiving box 20 is emptied, and will be raised again, after the passage of the emptied cloth piece receiving box 20, to position and stop the succeeding cloth piece receiving box 20, which is being conveyed on the endless conveyer chains 5, in this position. The emptied cloth piece receiving box 20 conveyed to the end by the endless conveyer chains 5 is pushed on one side surface by the endless conveyer chains 5 and is fed on the rollers 7 in the direction perpendicularly to the endless conveyer chains 5 so that the emptied cloth piece receiving box 20 will be transferred to the other endless conveyer chains 5 being driven reversely. During this moving, new cloth pieces 2 will be stacked in the empty cloth piece receiving box 20 by a suitable means.

The cloth piece receiving box 20 in which new cloth pieces 2 are received are conveyed, together with another adjacent receiving box 20, to the downstream side on the other endless conveyer chains 5. As the cloth piece receiving box 20 at this downstream end is pushed on the other side surface by the other pusher 9, it will be returned to the upstream end of the original endless conveyer chains 5 via the rollers 7. By the endless conveyer chains 5 and the rollers 7, a number of cloth piece receiving boxes 20 are conveyed successively in a circulating path. During this conveying, since the guide rollers 21*a* rotatably supported by the bottom plate 21 of each cloth piece receiving box 20 are guided rotating on the wall surfaces of the rectangular frame-like guide wall 3 and the intermediate guide wall 4, every cloth piece receiving box 20 will be conveyed on the conveying path smoothly without resistance.

Figure 7:
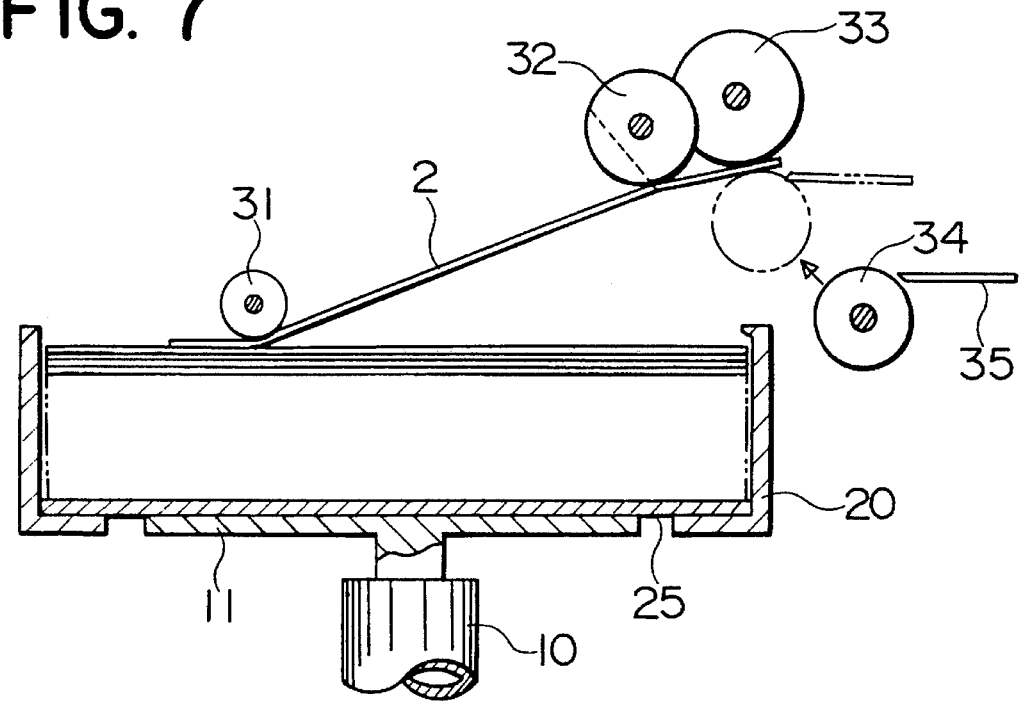
FIG. 7 is a schematic view showing the function of a first embodiment of the cloth piece pick-up apparatus.
Figure 8:
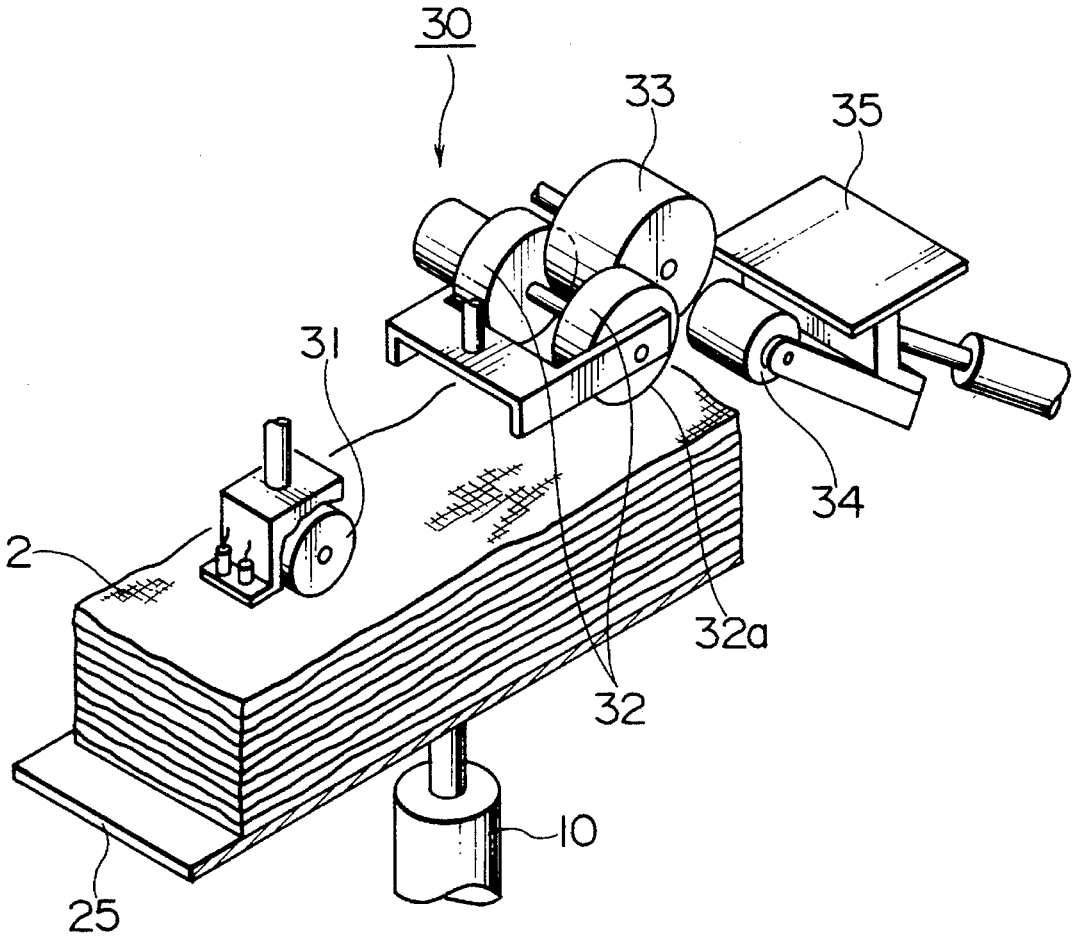
FIG. 8 is a fragmentary enlarged perspective view showing the first embodiment of the cloth piece pick-up apparatus.
Figure 9:
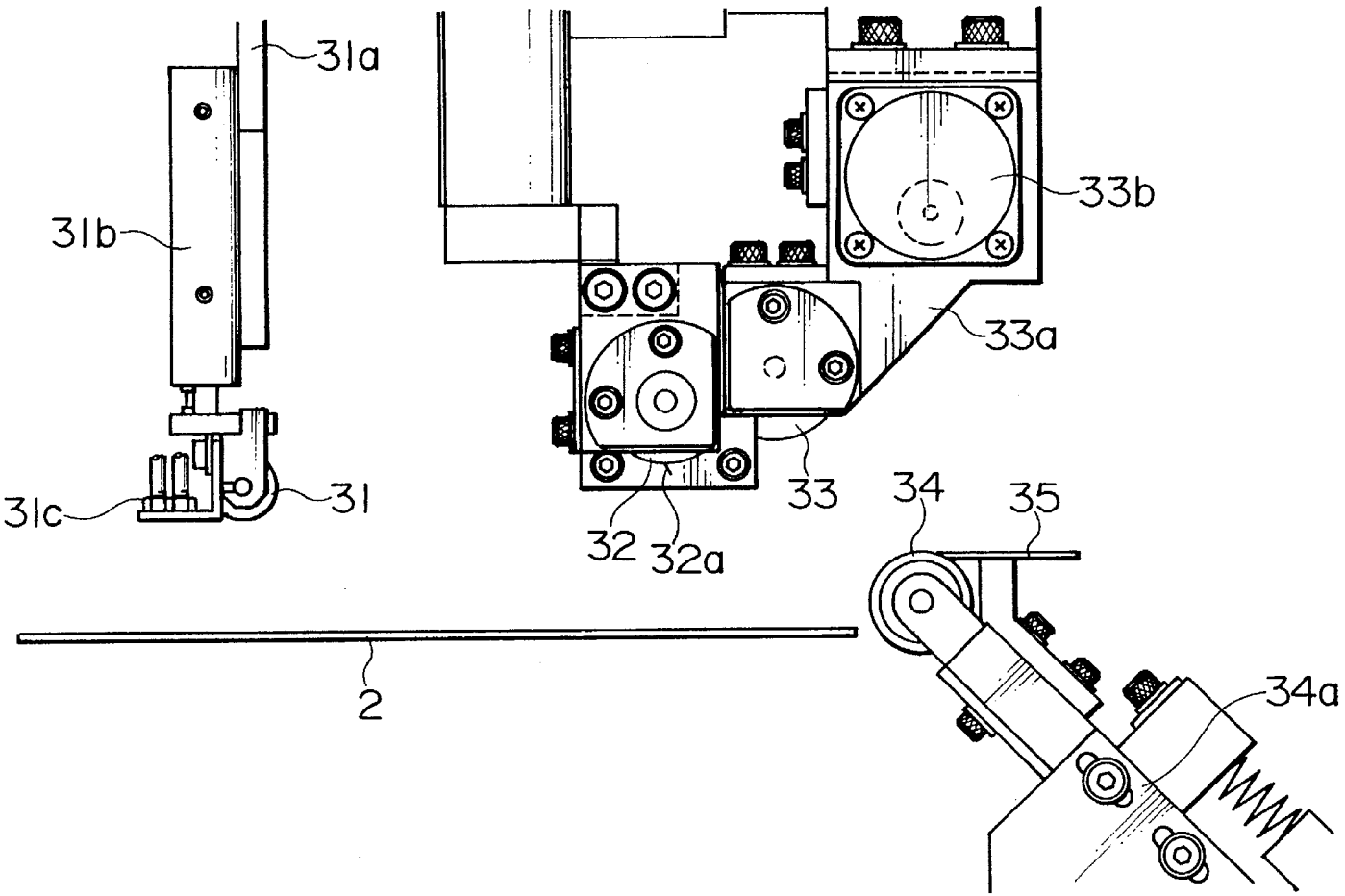
FIG. 9 is a view showing the detailed construction of the cloth piece pick-up apparatus with all movable parts in standby position.
Figure 10:
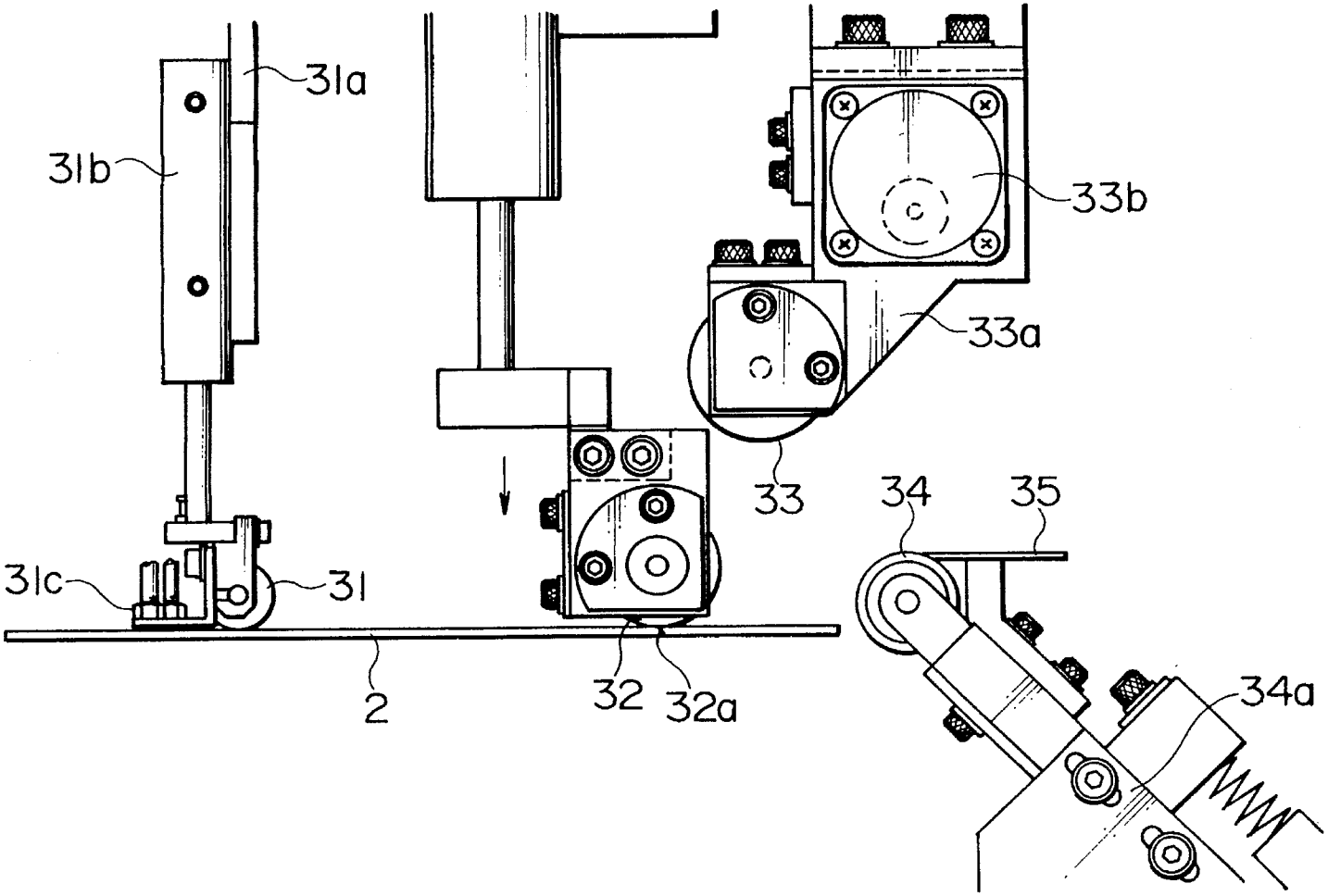
FIG. 10 shows the cloth piece pick-up apparatus when a cloth piece is picked up.

FIGS. 2, 7 and 8 show the general construction and operation of a typical cloth piece pick-up apparatus 30 according to a first embodiment of this invention. The cloth piece pick-up apparatus 30 comprises a pressing roller 31 as a pressing means for pressing on the trailing end (left side in these views) of front face of cloth pieces 2 received in stack in the receiving box 20 stopping in the cloth piece feed position, a catch roller 32 reciprocatingly movable between the position above the front end (right side in these views) of the cloth piece 2 and the front surface of the other end of the cloth piece 2, a feed roller 33 situated on the downstream side (right side in these views) of the catch roller 32, a pressure roller 34 reciprocatingly movable between the position diagonally downward and downstream of the feed roller 33 and the position contacting the feed roller 33, and a horizontal guide plate 35 downstream of the pressure roller 34 with its end adjacent to the upper surface of the pressure roller 34 and operatively connected with the pressure roller 34.

FIGS. 9 through 12 show the detailed construction and operation of the cloth piece pick-up apparatus 30. The cloth piece pick-up apparatus 30 is situated upwardly of the cloth supply part of the cloth piece conveying apparatus 1 as shown in FIG. 1. In opposite to the cloth piece discharge part of the cloth piece pick-up apparatus 30, a cloth piece feed apparatus 40 is situated for feeding the cloth pieces 2 with their front faces facing in the same direction to the succeeding sewing part 60.

The pressure roller 31 is situated upwardly of the trailing end of the cloth pieces 2 received in the cloth piece receiving box 20 stopping at a position under the pick-up apparatus 30, and is rotatably supported on the end of the rod of an air cylinder 31*b* fixed to the lower end of a bracket 31*a* extending perpendicularly from a non-illustrated machine frame. A photoelectric detector 31*c* is attached to the support portion where the pressing roller 31 is supported; the detector 31*c* discriminates the front/back face and presence/absence of the cloth piece 2 to issue a signal to the non-illustrated control unit.

The pressing roller 31 keeps stopping in the pressing position until all the cloth piece 2 stacked in the receiving box 20 have been successively picked up by the catch rollers 32. Upon completion of pick-up of all the cloth pieces 2, the pressing roller 31 is raised to the standby position and then waits in that position until the succeeding cloth piece receiving box 20 is conveyed to the position beneath thereof. When the succeeding receiving box 20 is conveyed to that position and is stopped there, the pressing roller 31*a* will be lowered to press a predetermined position of front face of the cloth piece 2 received in the receiving box 20.

The catch roller 32 includes a pair of rollers mounted on the output shaft of a drive source with a predetermined space therebetween as shown in FIG. 8, and has a number of catch needles 32*a* arranged in a straight row parallel to the circumferential surfaces and projecting by a length substantially equal to the thickness of a single cloth piece 2. The catch roller 32 along with the drive source is situated upwardly of the cloth piece 2 and is vertically movable toward and away from the front end of the cloth piece 2, and is attached to the end of the rod of the cylinder mounted on the non-illustrated machine frame. The cylinder is activated by an instruction from the non-illustrated control unit. The catch roller 32 is driven for rotation in a counterclockwise direction in FIGS. 9 through 12, and will be reciprocatingly moved between the raised position of FIG. 9 and the lowered position of FIG. 10 as the cylinder is activated every time a cloth piece 2 is picked up by the catch needles 32*a*.

The feed roller 33 is situated in such a position that part of the feed roller 33 is received between the pair of catch rollers 32 in the raised position. The feed roller 33, together with an electric motor 33*b*, is supported on the lower end of a bracket 33*a* extending downwardly from the non-illustrated machine frame, and is normally rotating in the cloth piece feeding direction. Therefore when the catch roller 32 catches the leading end of the cloth piece 2 and raises it, the leading end of the cloth piece 2 will come into contact with the lower end surface of the feed roller 33 as shown in FIG. 11.

Figure 11:
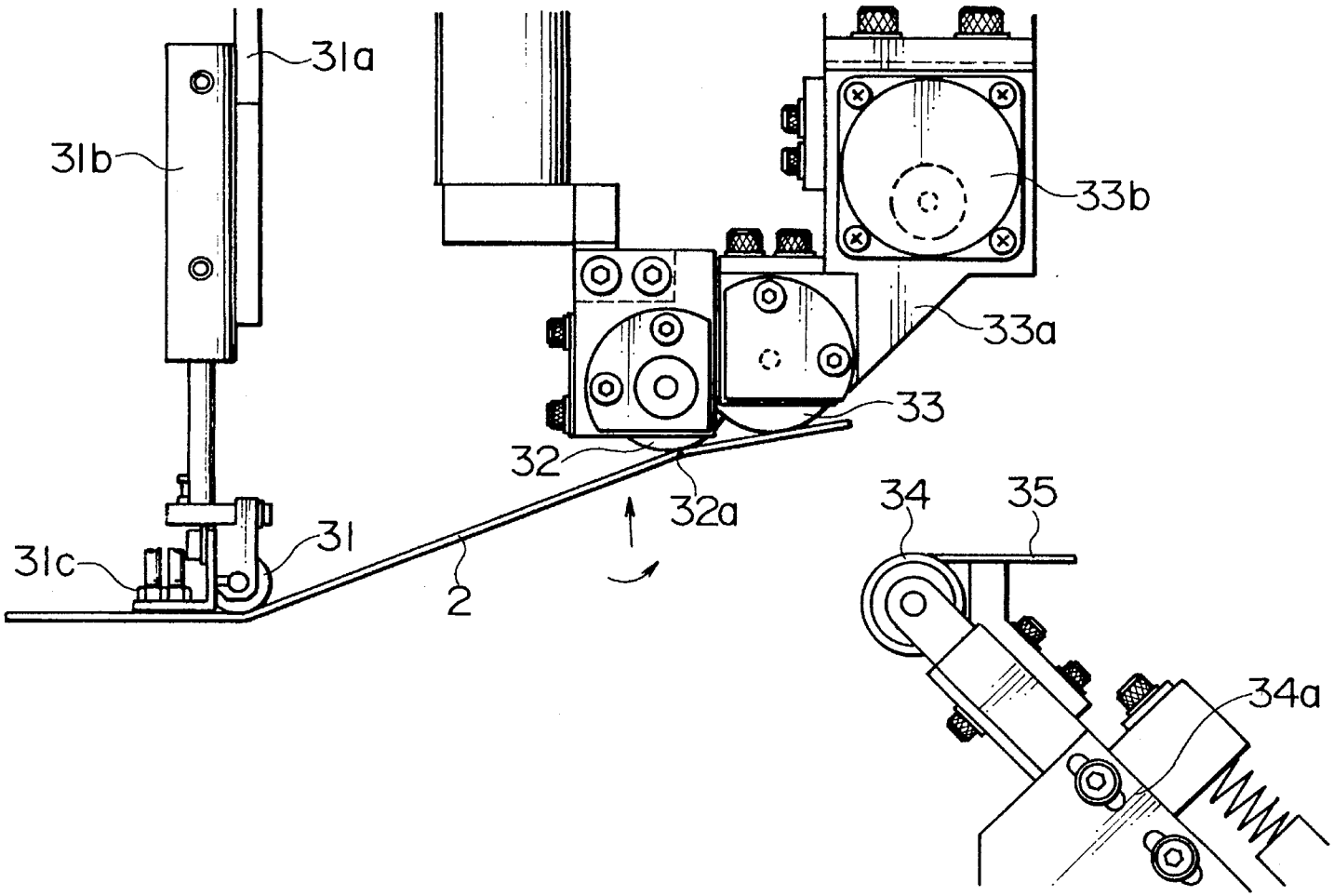
FIG. 11 shows the cloth piece pick-up apparatus when the picked up cloth piece is raised.
Figure 12:
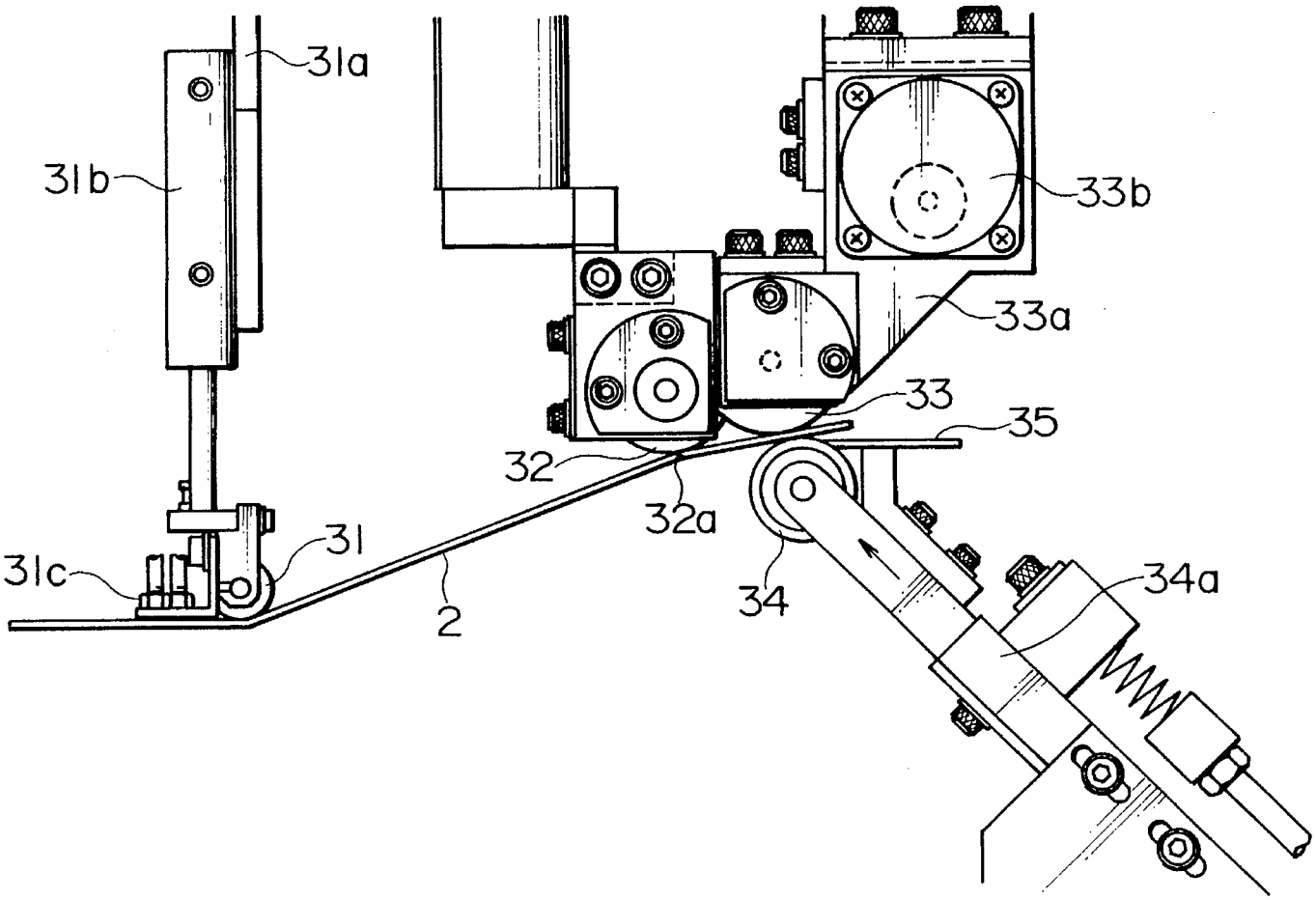
FIG. 12 shows the cloth piece pick-up apparatus when the picked up cloth piece is fed.

The pressure roller 34 is rotatably supported by the end of the rod of the cylinder 34*a* situated at the position diagonally downwardly and downstream of the feed roller 33 and is reciprocatingly movable between the standby position diagonally downward of the feed roller 33 as shown in FIG. 3 and the raised position contacting the feed roller 33 as shown in FIG. 11. Every timing of this reciprocating movement depends on the instruction from the non-illustrated control unit: a single cloth piece 2 is caught by the catch needles 32*a* (FIG. 10) and is then raised with the catch roller 32, and the pressure roller 34 is moved diagonally upwardly toward the feed roller 33 (FIG. 11) at the time when the leading end of the cloth piece 2 comes into contact with the lower surface of the feed roller 33 (FIG. 12), thereby clamping the leading end of the cloth piece 2 between the feed roller 33 and the pressure roller 34.

A horizontal guide plate 35 downstream of the pressure roller 34 with its end adjacent to the upper surface of the pressure roller 34 and operatively connected with the pressure roller 34. Therefore, the guide plate 35, like the pressure roller 34, is reciprocatingly movable between the standby position diagonally downward of the feed roller 33 and the raised position contacting the feed roller 33.

Since the feed roller 33 is rotating during the reciprocating movement of the pressure roller 34, the cloth piece 2 with the leading end in contact with the feed roller 33 will be positively fed downstream as clamped between the feed roller 33 and the pressure roller 34, during which the cloth piece 2 will be removed from the catch needles 32*a* of the catch roller 32 without resistance. Then the cloth piece 2 fed by the feed roller 33 will be fed downstream as guided on the upper surface of the guide plate 35.

When a single cloth piece 2 is fed forwardly, the pressing roller 31 will be lowered to the cloth piece pressing position where it will press against the front face of the cloth piece 2 to be picked up for the next. As the foregoing operation is repeated, the cloth pieces 2 stacked in the receiving box 20 are fed forwardly as picked up one by one from the top of the stack.

Figure 13:
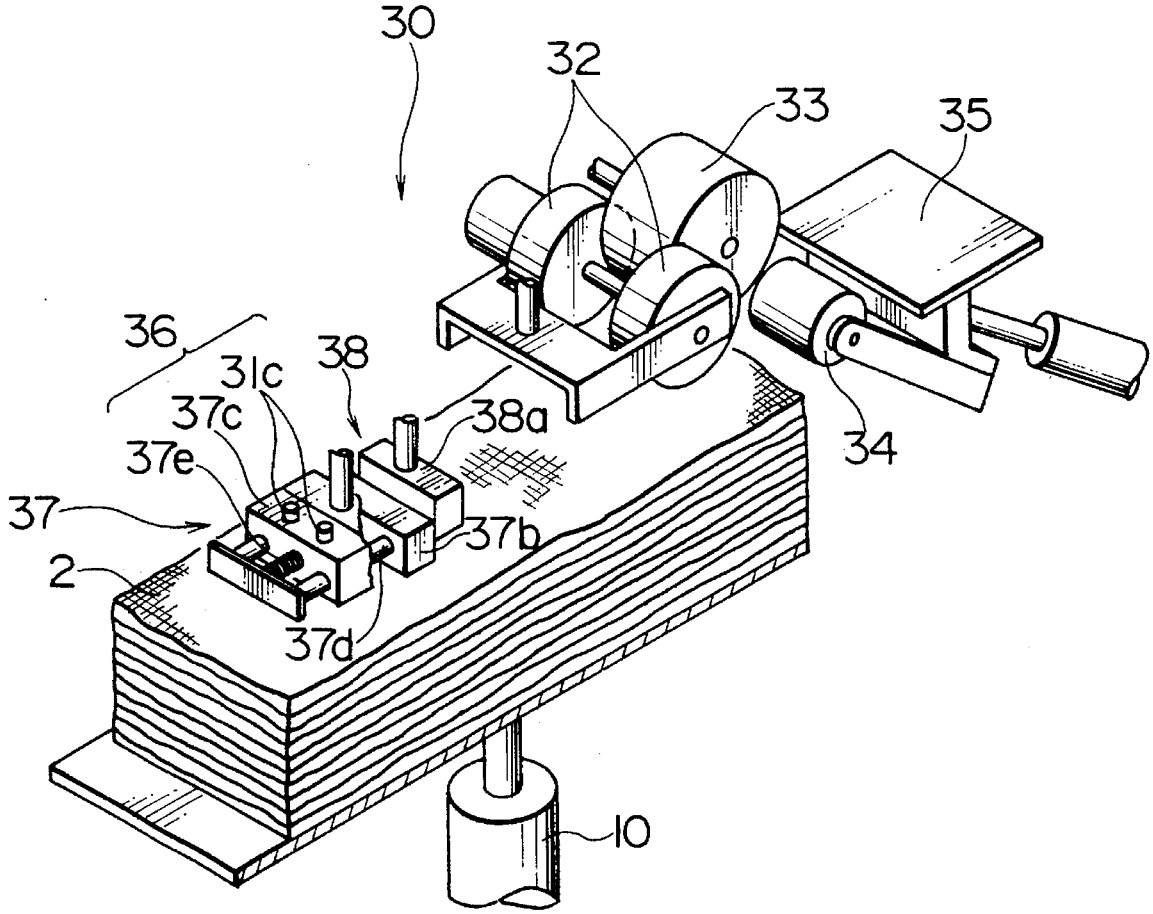
FIG. 13 is a fragmentary enlarged perspective view showing another typical example of cloth piece pressing means of the pick-up apparatus.

FIG. 13 is a fragmentary perspective view showing the general construction of a pressing means 36 of a typical cloth pick-up apparatus 30 according to a second embodiment of this invention. This embodiment is identical in construction and operation with the first embodiment except that the pressing means includes a pressing block part 37 and a cloth piece removing block part 38 instead of the pressing roller 31. Therefore the following description will concentrate on the pressing means 36 as the characteristic feature of this embodiment with reference to FIGS. 14 through 18. FIGS. 14 through 18 show the operation of the pressing means 36 in connection with the remaining members.

Figure 14:
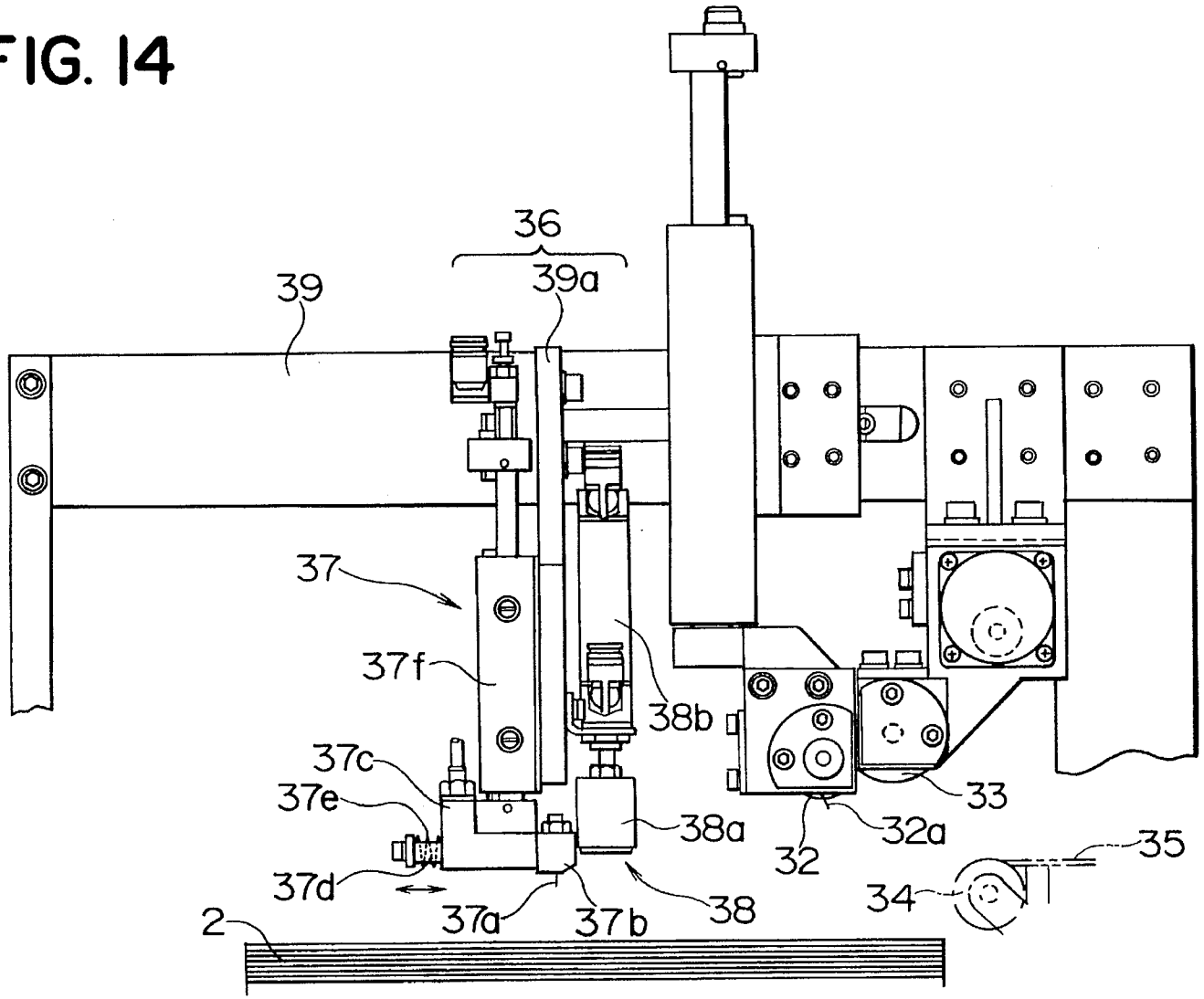
FIG. 14 shows the detailed construction of the cloth piece pick-up apparatus of FIG. 13 with all moving Parts in standby position.

In FIG. 14, the pressing means 36 includes a pressing block part 37 and a cloth piece removing block part 38 situated adjacent to and downstream of the pressing block part 37. The pressing block part 37 includes a pressing block 37*b* with a plurality of piercing needles 37*a* projecting from the bottom surface and arranged in a transverse row, and a cooperating block 37*c* vertically cooperative with the pressing block 37*b*. A connecting rod 37*d* is slidably inserted into the cooperating block 37*c*, and one end of the connecting rod 37*d* is fixedly connected to the pressing block 37*b* while the other end of the connecting rod 37*d* is resiliently connected to the cooperating block 37*c* via a spring 37*e*. In this illustrated embodiment, the pressing block 37*b* is situated downstream (right side in FIG. 14) of the cooperating block 37*c* and a compression spring is used for the spring 37*e*. Alternatively, the pressing block 37*b* and the cooperating block 37*c* may be situated in the reverse arrangement, in which case a tension spring should be used for the spring 37*e*. In either case, the pressing block 37*b* is normally urged along the cloth piece feeding path against the cooperating block 37*c* by the resilience of the spring 37*e*.

The pressing block part 37, like the pressing roller 31 of the first embodiment, is situated upwardly of the trailing end of the cloth pieces 2 received in the non-illustrated cloth piece receiving box staying under the pick-up apparatus. The cooperating block 37*c* is fixedly connected to the end of the rod of an air cylinder 37*f* fixed to the lower portion, which is remote from the catch roller 32, of a bracket 39*a* extending downwardly from a machine frame 39. A photoelectric detector 31*c* is attached to the cooperating block 37*c* of the pressing block part 37; the detector 31*c* discriminates the front/back and presence/absence of a cloth piece 2 and issues an appropriate signal to a non-illustrated control unit. The pressing block part 37 will be lowered to the pressing position every time the uppermost one of cloth pieces 2 stacked in the non-illustrated receiving box is picked up by the catch roller 32, and the pressing block part 37 will be raised to the standby position upon completion of pick-up of the uppermost cloth piece 2.

The cloth piece removing block part 38 includes a cloth piece removing block 38*a*, and an air cylinder 38*b* for vertically moving the cloth piece removing block 38*a*, the cloth piece removing block 38*a* being fixed to the end of the rod of the air cylinder 38*b*. The air cylinder 38*b* is fixed to the bracket 39*a* and is situated between the pressing block part 37 and the catch roller 32. The air cylinder 38*b*, like the air cylinder 37*f*, of the pressing block part 37, will be activated by an instruction from the non-illustrated control unit. This cloth piece removing block part 38 is normally in the standby position as shown in FIG. 14, and will be lowered to push the cloth piece 2 off the piercing needles 37*a* when the cloth piece 2 pierced by the piercing needles 37*a* of the pressing block 37*b* is raised.

Upon completion of pick-up of the previous cloth piece 2, the pressing block 37*b* will be lowered in synchronism with the catch roller 32 to press against a predetermined portion of the front face of the uppermost one of cloth pieces 2 stacked in the receiving box as shown in FIG. 15. Simultaneously with this pressing, the catch roller 32 is driven for rotation in a counterclockwise direction in FIG. 15 so that the cloth pieces 2 are picked up one by one by the catch needles 32*a*. At that time, since the pressing block 37*b* is moved in the cloth piece feeding direction against the resilience of the compression spring 37*e* via the connecting rod 37*d* inserted into the cooperating block 37*c*, excessive tension can be escaped following the action of the cloth piece 2 when it is taken up by the catch needles 32*a* of the catch roller 32, so that the cloth piece 2 is prevented from being damaged by either the piercing needles 37*a* of the pressing block 37*b* or the catch needles 32*a* of the catch roller 32.

Figure 16:
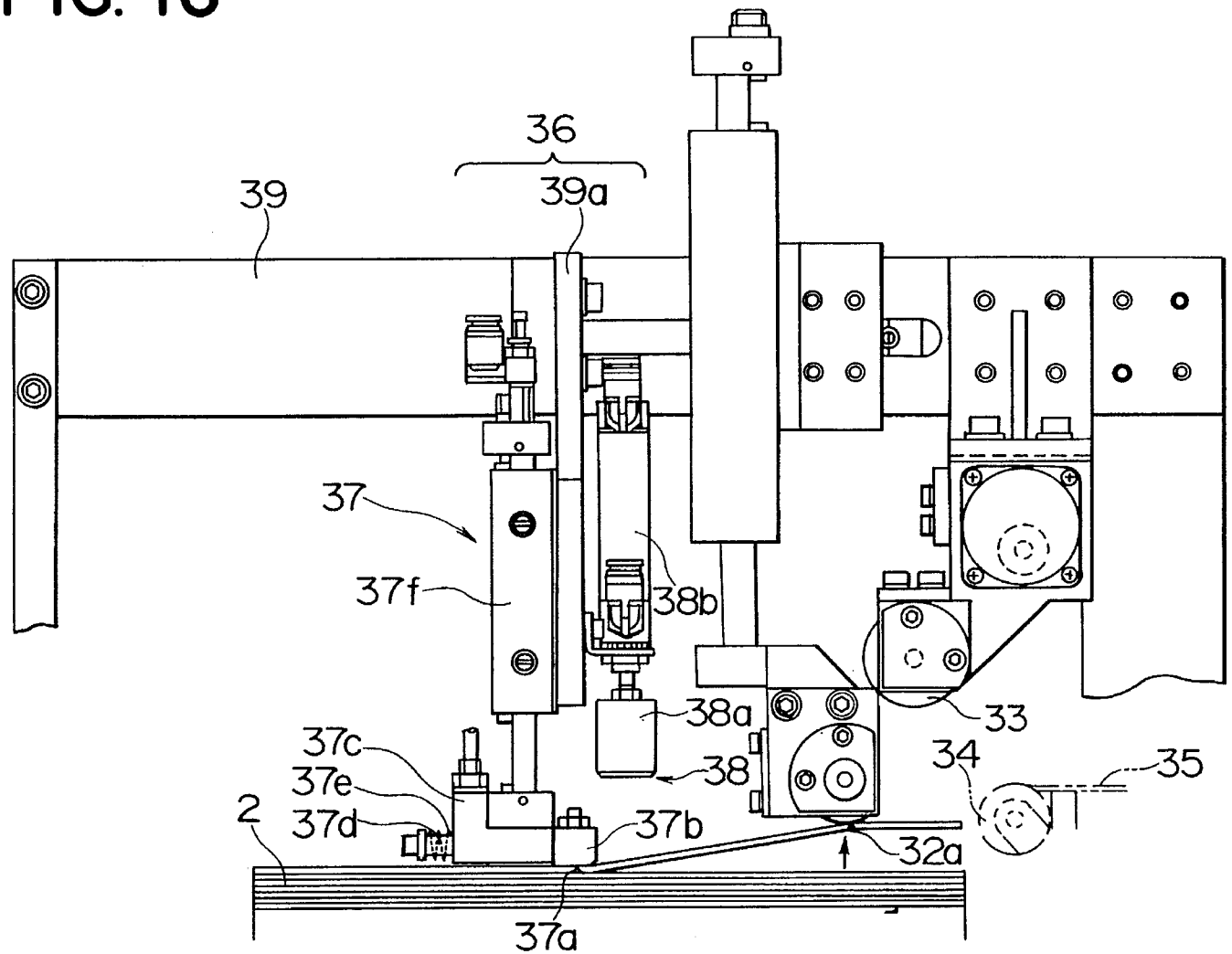
FIG. 16 shows the cloth piece pick-up apparatus of FIG. 13 when the cloth piece is picked up.
Figure 17:
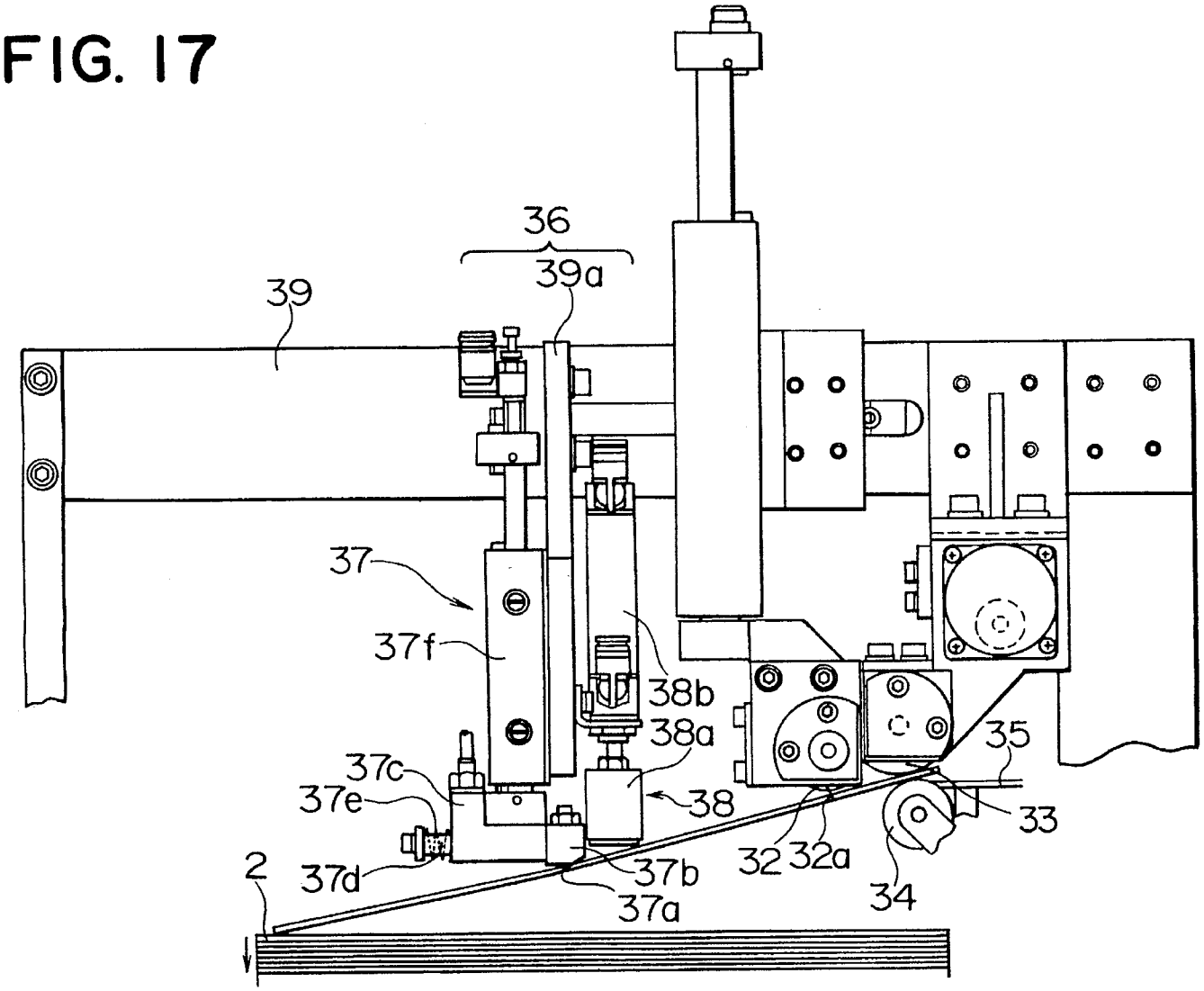
FIG. 17 shows the cloth piece pick-up apparatus of FIG. 13 when the picked up cloth piece is raised.
Figure 18:
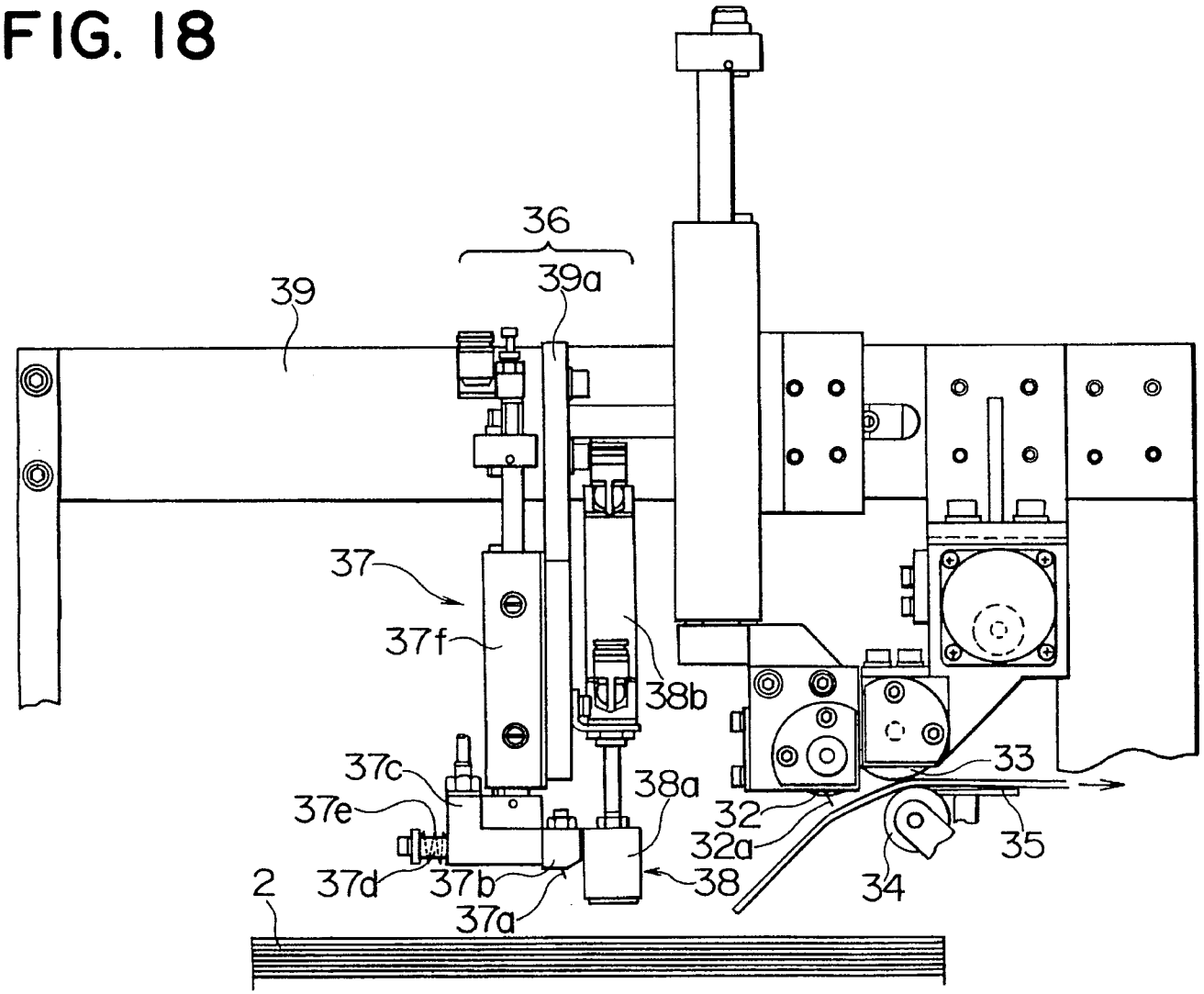
FIG. 18 shows the cloth piece pick-up apparatus of FIG. 13 when the picked up cloth piece is fed.

Now, as shown in FIG. 16, the catch roller 32 in driven rotation starts to move upwardly, and then the pressing block 37*b* starts to move upwardly with a predetermined time difference. When the catch roller 32 reaches the upper limit and the leading end of the cloth piece 2 is clamped between the feed roller 33 and the pressure roller 34 as shown in FIG. 17, the cloth piece removing block part 38 is activated to lower the cloth piece removing block 38*a* so that the cloth piece removing block 38*a* pushes on the upper surface of the cloth piece 2 downwardly to remove the cloth piece 2 from the catch needles 37*a*. The cloth piece 2 removed from the catch needles 37*a* will then be fed to the next station as guided by the guide plate as shown in FIG. 18. By repeating the foregoing operation, the cloth pieces 2 will be picked up reliably one by one from the stack.

FIGS. 19 through 22 show the cloth piece feed apparatus 40 to be situated between the cloth piece pick-up apparatus 30 and the sewing part 60. But the structure and function of the cloth piece feed apparatus 40 should be no means be limited to the illustrated example.

Figure 19:
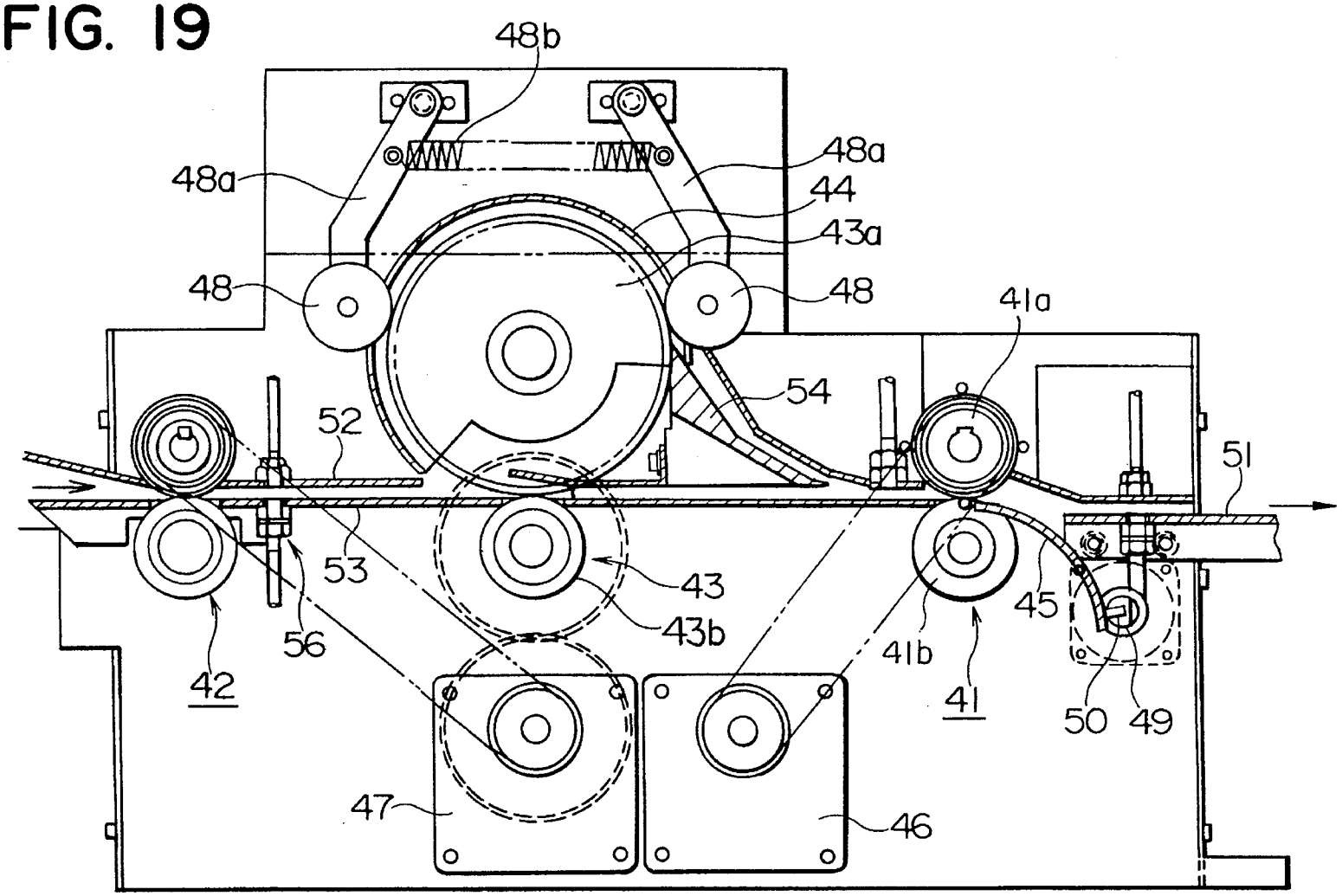
FIG. 19 is a vertical cross-sectional view showing the posture of the cloth piece feed apparatus while the cloth piece is fed in a straight path.

First of all, the main construction of the cloth piece feed apparatus 40 will be described with reference to FIG. 19. The cloth piece feed apparatus 40 includes vertical pairs of first and second feed rollers 41, 42 situated in the cloth piece feed path at downstream and upstream positions with a predetermined distance, a vertical pair of inverting feed rollers 43 situated between the first and second feed roller pairs 41, 42, a first feed path switching member 44 situated in the cloth piece feed path of the inverting feed rollers 43, a second feed path switching member 45 situated in the cloth piece discharge path of the downstream side or first feed roller pair 41, and at least a front/back face detector 56 situated adjacent to the second feed roller pair 42.

What to be noted in connection with this kind of cloth piece supply station is that the cloth pieces must be rearranged in such a manner that front faces face in the same direction, before being fed to the next station. This problem is inevitable as long as it is intended to stack the successive cloth pieces efficiently. It has currently been a common practice to fold a continuous strip of cloth in a zig-zag pattern and then to cut the cloth strip into a predetermined shape of cloth pieces. Consequently, front faces of every other cloth pieces of the stack faces inversely; if the thus stacked cloth pieces are fed one after another to the next station, the successive cloth pieces will be received in that station necessarily with front faces facing up and down alternately. In order to place all cloth pieces with front faces face in the same direction, a means for placing the successive cloth pieces with front faces facing in the same direction must be situated in the cloth piece feed path. Further, the cloth pieces 2 prepared from the folded continuous strip will not necessarily be fed alternately.

The first and second feed roller pairs 41, 42 will be positively rotated as their upper rollers 41*a*, 42*a* are controllably driven by electric motors 46, 47, respectively, while the lower rollers 41*b*, 42*b* are free to rotate. The second feed rollers 42 at the upstream side rotates in one way so as to feed the cloth piece 2 normally forwardly, and the first feed rollers 41 at the downstream side inverts and reversely feeds the cloth piece 2 only when the back face of the cloth piece 2 faces upwardly. The upper roller 43*a* of the inverting feed rollers 43 has a larger diameter than the other rollers 41*a*, 42*a*, 43*b* and is rotatable forwardly and reversely. When the Cloth piece 2 is fed reversely from the first feed rollers 41, the upper inverting feed roller 43*a* is reversely rotated to inverse the cloth piece 2 and to feed it again to the first feed rollers 41 via the inverting feed path. For inverting the cloth piece 2, a pair of pressing rollers 48 are situated upwardly of the upper inverting feed roller 43*a* for pressing the upper inverting feed roller 43*a* from opposite sides. The pressing rollers 48 are rotatably mounted on free arms of a pair of pivoting levers 48*a* and are resiliently touching the upper inverting feed roller 43*a* by a tension spring 48*b* mounted between the two pivoting levers 48*a*.

The first feed path switching member 44 is a fan-shape cover covering the upper inverting feed roller 43*a* over about 240° and adapted to be controllably swung about the axis of the upper inverting feed roller 43*a* through a predetermined range by a non-illustrated swinging mechanism, thereby switching the feed path between a straight feed path extending through the first and second feed roller pairs 41, 42 and an inverting feed path defined by the circumferential surface of the upper inverting feed roller 43*a*. In order to avoid any interference with the pressing roller 48, part of the circumferential surface of the first feed path switching member 44 is cut out.

The second feed path switching member 45 serves to direct the cloth piece 2, which is fed from the first feed rollers 41, selectively to the outlet of the straight path extending through the first and second feed roller pairs 41, 42 or to the shunting path downwardly of the outlet of the straight path. In the illustrated example, the second feed path switching member 45 is an arcuately curved plate cantilevered by an intermediate member 50 projecting radially from the motor shaft 49. By rotating the motor shaft 49 reciprocatingly through a predetermined angle, the second feed path switching member 45 moves between the position of FIG. 19 in which the cloth piece 2 is directed to the outlet of the straight path and the position of FIG. 20 in which the cloth piece 2 is directed to the shunting path.

The forward and reverse rotation of the first feed rollers 41 and the upper inverting feed roller 43*a* as well as the switching operation of the first and second feed path switching members 44, 45 are performed according to the respective instruction from the non-illustrated control unit, based on the detection signal of the front/back face detector 56. In this embodiment, a light detecting means is used for the front/back face detector 56, and the detector 56 is situated adjacent to the second feed rollers 42 as described above. Additional detector 56 may be situated inside the cloth piece pick-up apparatus 30 in the previous station.

In this embodiment, in order to form the straight path for feeding the cloth piece 2, guide plates 52, 53 are situated over and under the feed path between the rollers. In order to define the inverting path, there are situated, in addition to the first feed path switching member 44, a guide plate 54 having a generally triangular cross section leading from the position in which the pressing roller 48 at the downstream side (right side as illustrated) contacts the upper inverting feed roller 43*a* to the straight path, and another guide plate 55 confronting the cloth guide surface of the guide member 54.

Now, when a cloth piece 2 is supplied to the cloth piece pick-up apparatus 30 to the cloth piece feed apparatus 40, whether the upwardly facing face of the supplied cloth piece 2 is the front face or the back face will be detected by the front/back face detector 56. If the cloth piece 2 is supplied with the front face up, the detector 56 will issue to the non-illustrated control unit a detection signal indicating that the front face is up, whereupon the control unit will issue an instruction to the individual parts of the cloth piece feed apparatus 40, based on that detection signal. In this case, the first and second feed path switching members 44, 45 are located in the position of FIG. 19, and the first feed rollers 41 and the inverting feed rollers 43 are rotated in the same direction as that of the second feed rollers 42, thereby feeding the cloth piece 2 forwardly along the straight path without inverting it.

If the cloth piece 2 is supplied from the cloth piece pick-up apparatus 30 with the back face up, the front/back face detector 56 will issue to the control unit a signal indicating that the back face is up, whereupon the control unit will issue an instruction to the various parts of the cloth piece feed apparatus 40, based on that detection signal.

Figure 20:
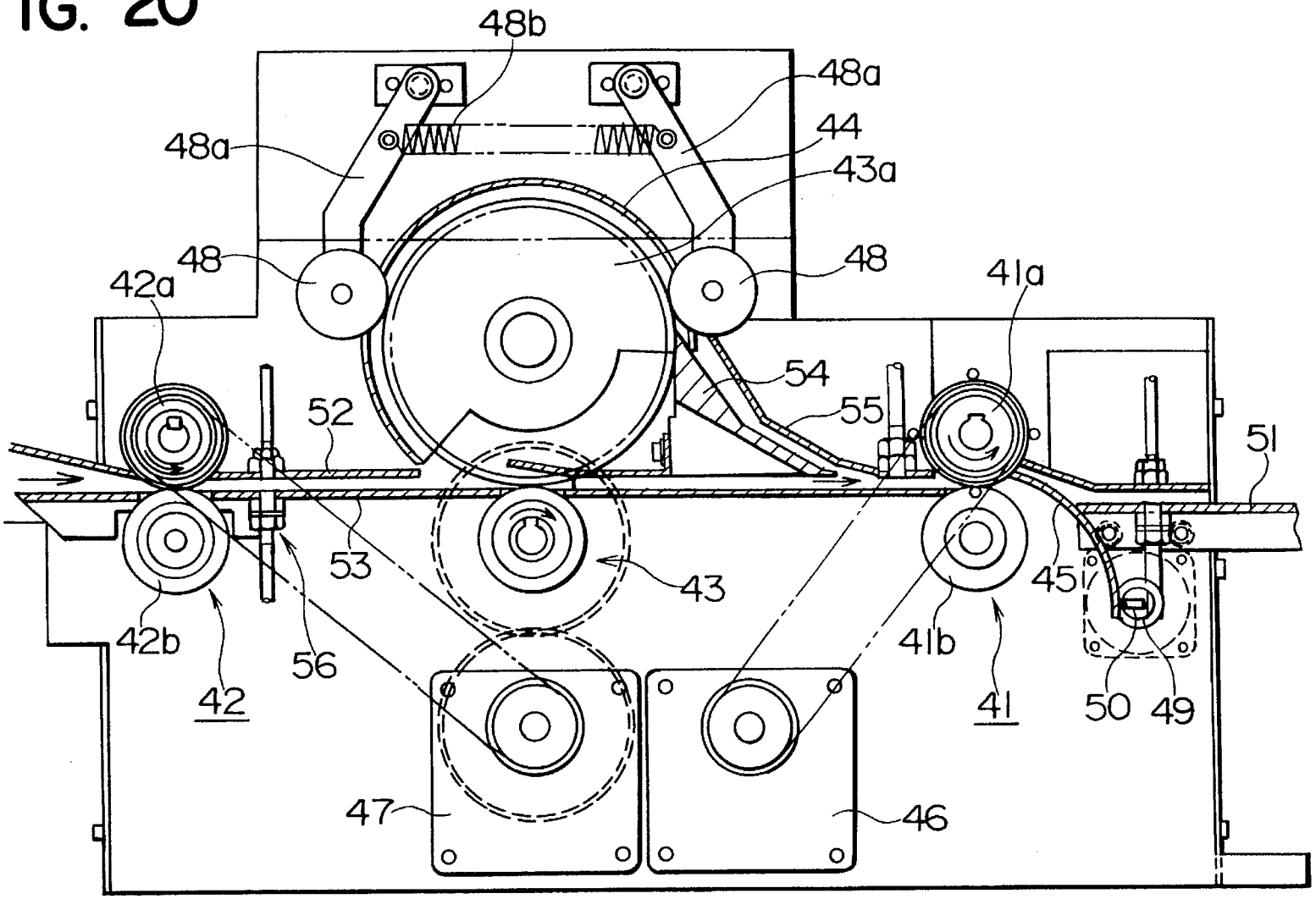
FIG. 20 shows the posture of the cloth piece feed apparatus at a first stage when the cloth piece is inverted.
Figure 21:
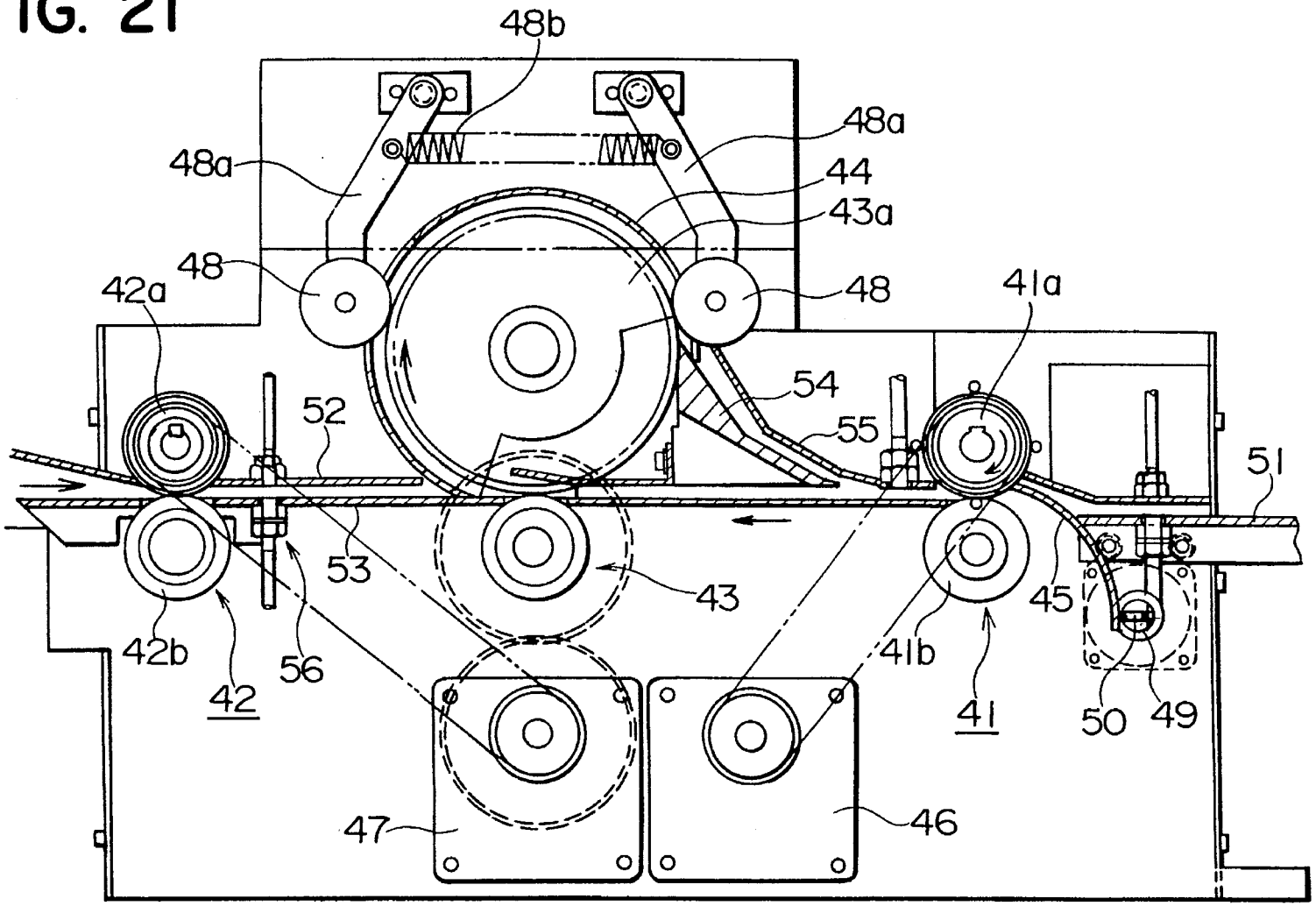
FIG. 21 shows the posture of the cloth piece feed apparatus at a second stage when the cloth piece is inverted.

By this instruction signal, the second feed path switching member 45 is activated to assume the position of FIG. 20 in which the free end is situated adjacent to the upper roller 41*a* of the first feed roller pair 41, while the first feed path switching member 44 keeps the original position. Now, when the first feed path roller pair 41 and the inverting feed rollers 43 are rotated in the same direction as that of the second feed rollers 42 to feed the cloth piece 2 forwardly, and then the second feed path switching member 45 guides the cloth piece 2 to the shunting path under the first feed rollers 41. Before the trailing end of the cloth piece 2 leaves off the first feed rollers 41, the first feed rollers 41 are reverse rotated to feed the cloth piece 2 in the reversely rotated to feed the cloth piece 2 in the feed path switching member 44 is activated to close the straight feed path on the side toward the second feed rollers 42. At that time, the inverting feed rollers 43 are reversely rotated to invert and feed the cloth piece 2, which is reversely fed by the reverse rotation of the first feed rollers 41, along the circumferential surface of the reversely rotating inverting feed rollers 43. When the cloth piece 2 starts to be inverted and fed along the circumferential surface of the upper inverting feed roler 43*a*, the second feed path switching member 45 will be activated in such a manner that the free end will leave off the upper roller 41*a* of the first feed rolelrs 41 to shift the outlet of the feed path of the first feed roller pair 41 to the straight path leading to a transfer table 51.

Figure 22:
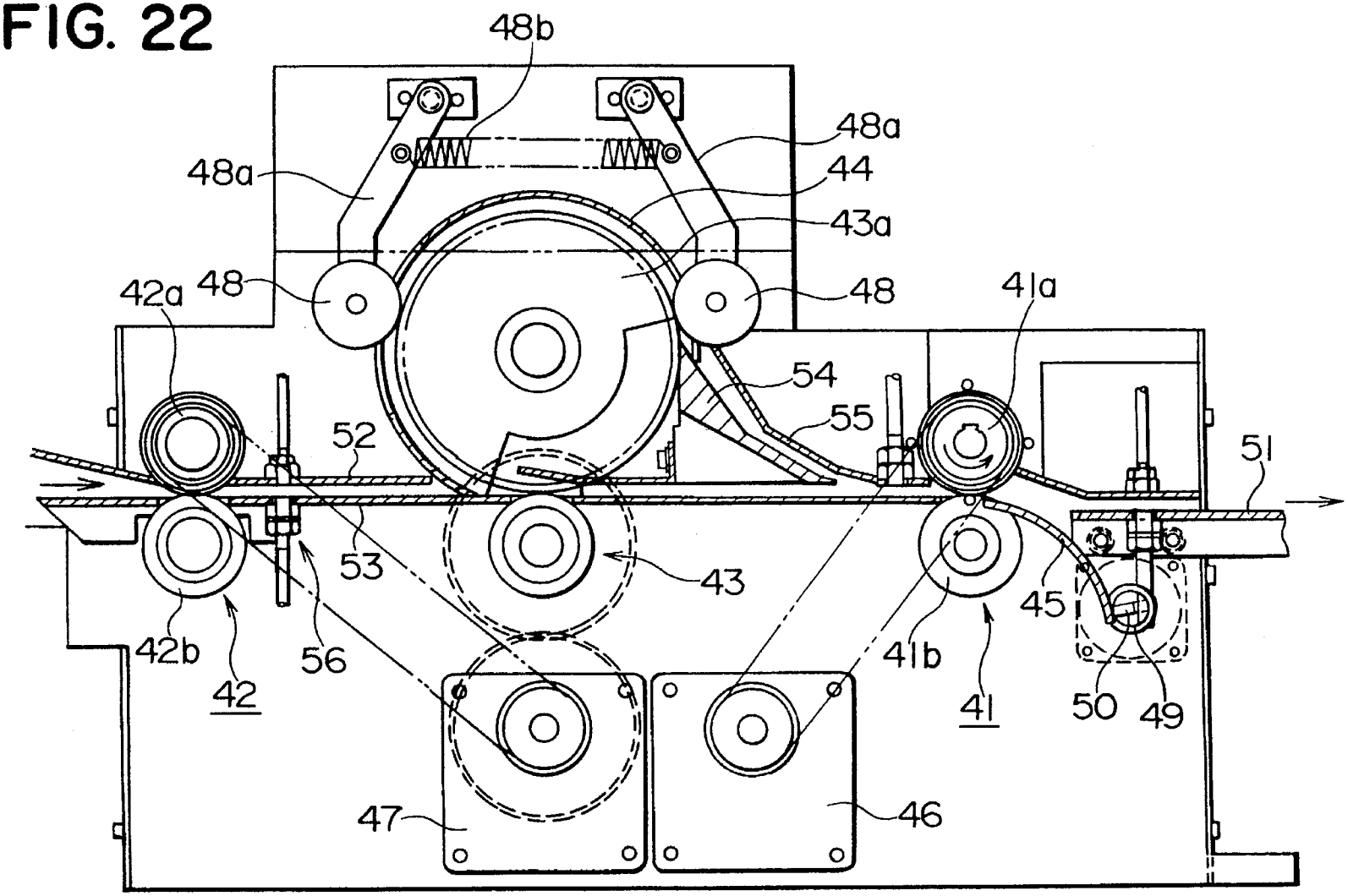
FIG. 22 shows the posture of the cloth piece feed apparatus at a third stage when the cloth piece is inverted.

By the foregoing operation of the individual parts, the cloth piece 2 fed reversely as shown in FIG. 22 will be fed, with the front face up, along the circumferential surface of the upper inverting feed roller 43*a* as guided by the first feed switching member 44 and will then reach the straight path upstream of the first feed rollers 41 via the inverting path, whereupon the cloth piece 2 will be transferred onto the transfer table 51 along the straight path and will be discharged to the next station of the sewing part 60.

Since the sewing part 60 subsequent to the foregoing cloth piece feed apparatus 40 is identical in construction and operation with that of the prior art, its detailed description is omitted here. In this embodiment, the cloth piece pick-up apparatus 30 is applied to a sewing machine for sewing cloth pieces, which are to be used for trousers of denim, successively to a continuous slide fastener chain. This invention should by no means be limited to such sewing machine, and may be applied also to all kinds of cloth piece processing machines in which small cloth pieces are supplied successively at high speed.

As is apparent from the foregoing description, according to the cloth piece supply method and apparatus of this invention, partly since the cloth piece conveying apparatus, the cloth piece pick-up apparatus and the cloth piece feed apparatus are combined functionally, and partly since each apparatus has the foregoing construction to cope with high-speed operation, it is possible to supply the cloth pieces at high speed.

With the cloth piece conveying apparatus, since it is in the form of a rectangular frame-like circulating path, a number of cloth piece receiving boxes can be supported efficiently using space with maximum efficiency. Further, since the elevating plate movable upwardly in timed relation with the cloth piece pick-up rate is situated in the cloth pick-up position of the circulating path to raise the cloth pieces stacked in the receiving box gradually so that the uppermost cloth piece to be picked up will be positioned always at a predetermined level, it is possible to maintain a reliable pick-up function and to reduce the motion of the pick-up apparatus so that the construction can be simplified.

Regarding the cloth piece pick-up apparatus, the vertically stacked cloth pieces are picked up one by one from the top of the stack, and the leading end of the picked up cloth piece is caught by the catch needles of the rotating roller while the trailing end is pressed in position. Under a predetermined tension, the cloth pieces are caught and raised one by one reliably, and at the raised position, the cloth piece is positively fed forwardly as its leading end is clamped between the feed roller and the pressure roller. Therefore it is possible to prevent the cloth pieces from being damaged and to make the construction simple as well as to cope with high-speed operation. Further, since the trailing end of the cloth piece is pressed by the pressing means and the pressing means somehow follows the cloth piece take-up action even if the catch roller fials to catch the cloth piece, it is possible to minimize the possible divergence and damage of the cloth pieces. Since the cloth piece can be taken up once again, it is unnecessary to interrupt the operation of the apparatus.

According to the cloth piece feed apparatus, the cloth pieces, which are fed in a horizontal posture and with their front faces facing in disorder, i.e. upwardly and downwardly, can be fed to the next station with the front faces facing orderly, i.e. upwardly. Since the cloth pieces can be fed by the rotating rollers always along the guide path, it is possible to cope with high-speed feeding. Further, since the cloth piece is free from any excessive force, no inconveniences such as damage of cloth piece would occur.

What is claimed is:

1. A cloth piece supply machine for conveying successive cloth pieces in a stack, picking up the cloth pieces one by one from the top of the stack and supplying the cloth pieces, with their front faces facing in the same direction, to a subsequent station, said machine comprising:

(A) a cloth piece conveying apparatus situated under a cloth piece pick-up position, in which the cloth pieces accommodated in the stack in a cloth piece receiving box are to be picked up one by one from the top of the stack and are to be supplied to the subsequent station, and having a conveying path for conveying a plurality of said receiving boxes succeeding to said pick-up position;

(B) a cloth piece pick-up apparatus situated in said cloth piece pick-up position, said cloth piece pick-up apparatus including (i) pressing means for pressing one end of the top cloth piece from above, and (ii) a catch roller having catch needles on a part of circumferential surface thereof and movable toward and away from another end of the top cloth piece, said catch roller being adapted to be driven for rotation to feed the top cloth piece to move the top cloth piece in a direction away from said pressing means; and (C) a cloth piece feed apparatus situated adjacent to a cloth piece discharge port of said cloth piece pick-up apparatus for feeding the cloth pieces, with front faces facing in the same direction, to the subsequent station.

2. A cloth piece supply machine according to claim 1, wherein said conveying path of said receiving box is a rectangular frame-shape circulating path, there being situated in said conveying path automatic conveying means for conveying said receiving boxes and also an elevating plate for controlling the vertical movement of said receiving box.

3. A cloth piece supply machine according to claim 2, further including positioning means situated adjacent to and downstream of said elevating plate for positioning said receiving box.

4. A cloth piece supply machine according to claim 2, wherein said receiving box has in its bottom an opening for the passage of said elevating plate, there being supported on said bottom a cloth piece support plate.

5. A cloth piece supply machine according to claim 2, wherein said receiving box is adjustable with respect to a distance between pairs of opposed sidewalls.

6. A cloth piece supply machine according to claim 1, further including a feed roller rotatable in timed relation with said catch roller, and a pressure roller movable toward and away from a cloth-piece-feed surface of said feed roller and rotatable in cooperation with said feed roller.

7. A cloth piece supply machine according to claim 1, wherein said pressing means is a pressing roller.

8. A cloth piece supply machine according to claim 1, wherein said pressing means includes a pressure block having on its bottom catch needles and resiliently movable in a direction of movement of the pulled cloth piece, and a cloth piece removal block for removing the cloth piece off said catch needles.

9. A cloth piece supply machine according to claim 1, further comprising a guide plate having one end which is contiguous to an upper surface of said pressure roller and extends horizontally in a direction of discharging the cloth piece and being cooperative with said pressure roller.

10. A cloth piece supply machine according to claim 1, wherein said cloth piece feed apparatus includes a pair of upper and lower first feed rollers situated at said cloth piece discharge port and rotable in forward and reverse directions, a pair of upper and lower second feed-rollers rotatable so as to feed the cloth pieces in one direction, a pair of upper and lower reverse feed rollers situated centrally between said pair of first feed rollers and said pair of second feed rollers and rotatable in forward and reverse directions, a first feed path switching member situated in a cloth piece feed path of said reverse feed rollers for guiding the cloth pieces selectively in forward and reverse feed directions, and a second feed path switching member situated downstream of said first feed rollers for guiding the cloth pieces selectively to a normal position in the cloth piece path and a shunting position.

11. A method for picking up cloth pieces in a stack one by one from the top of the stack, using said cloth piece pick-up apparatus as defined by claim 1, by repeating the following steps for feeding the cloth pieces successively to a subsequent manufacturing station:

(a) bringing said catch roller, which is in rotation as being driven, close to a surface of a leading end portion of the top cloth which is opposite to a trailing end portion pressed on the surface by said pressing means;

(b) catching the top cloth piece with the catch needles of said catch roller and, at the same time, raising the top cloth piece to bring the surface of the leading end portion of the cloth piece into contact with the feed surface of said feed roller, said feed roller being a driven roller; and (c) pressing the leading end portion of the cloth piece against said feed roller by said pressure roller which is moved at the same time when the leading end portion of the cloth piece is brought into contact with the feed surface of said feed roller.

12. A cloth piece pick-up method according to claim 11, wherein the cloth pieces in stack are raised stepwise at a pitch corresponding to the cloth thickness in a cloth piece pick-up position in time relation with the action of picking up.

* * * * *